US010525746B2

(12) United States Patent
Yoshino et al.

(10) Patent No.: US 10,525,746 B2
(45) Date of Patent: Jan. 7, 2020

(54) RECORDING APPARATUS

(71) Applicant: SEIKO EPSON CORPORATION, Tokyo (JP)

(72) Inventors: Satoshi Yoshino, Matsumoto (JP); Kensuke Tamai, Shiojiri (JP); Eiji Taketsugu, Matsumoto (JP); Hitoshi Igarashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/914,433

(22) Filed: Mar. 7, 2018

(65) Prior Publication Data

US 2018/0272763 A1 Sep. 27, 2018

(30) Foreign Application Priority Data

Mar. 23, 2017 (JP) ..... 2017-057906
Aug. 10, 2017 (JP) ..... 2017-155731

(51) Int. Cl.
*B41J 13/10* (2006.01)
*B41J 11/00* (2006.01)

(52) U.S. Cl.
CPC ..... *B41J 13/106* (2013.01); *B41J 11/0045* (2013.01)

(58) Field of Classification Search
USPC ..... 271/9.05
See application file for complete search history.

(56) References Cited

U.S. PATENT DOCUMENTS

2005/0162494 A1 7/2005 Inokuchi et al.
2012/0195669 A1* 8/2012 Nakamura ..... B65H 1/266 400/578

FOREIGN PATENT DOCUMENTS

JP 2004-338873 A 12/2004
JP 2013-209190 A 10/2013

* cited by examiner

*Primary Examiner* — Lam S Nguyen
(74) *Attorney, Agent, or Firm* — Workman Nydegger

(57) ABSTRACT

A recording apparatus includes a paper discharging tray constituted of a first tray and a second tray which are capable of being displaced along a medium discharging direction, the paper discharging tray can be stored in the recording apparatus, a motor which drives the paper discharging tray and a transmission unit which transmits power of the motor to the paper discharging tray includes a first gear which comes into contact with the first tray and transmits the power of the motor to the first tray and a second gear which comes into contact with the second tray and transmits the power of the motor to the second tray.

10 Claims, 32 Drawing Sheets

RECORDING APPARATUS

BACKGROUND

1. Technical Field

The present invention relates to a recording apparatus including a medium receiving portion which receives a medium after being recorded.

2. Related Art

A recording apparatus represented by a printer or the like is provided with a discharging unit such as a pair of discharging rollers on a downstream side of a recording unit, which performs recording on paper as a medium, and is configured so that paper after being recorded is discharged to the outside of the apparatus and is also received by a medium receiving tray as a medium receiving portion (also referred to as a stacker).

Also, in order to compactly store the medium receiving tray in an apparatus main body and to receive paper which is elongated in a discharging direction, a multistage type medium receiving tray including a plurality of trays overlapped in a storage state may be adopted (for example, JP-A-2004-338873).

Here, in JP-A-2004-338873 which is an example of the multistage type medium receiving tray, a paper discharging tray 14 (corresponding to the medium receiving tray) is configured so that four tray plates are expanded and contracted by a link mechanism 26 (FIG. 8 of JP-A-2004-338873).

In addition, in the configuration of JP-A-2004-338873, a driving gear 56 fixed to a main shaft of a motor 55 transmits a driving force to a gear to be driven 57, which is fixed to a link 28, through an intermediate gear 58, and thus the link mechanism 26 expands and contracts, and furthermore, the four tray plates slide.

Here, in a case in which the friction force among the four tray plates increases due to abrasion or the like, links 28 and 29 bend during the transmission of the driving force of the motor 55 to the link mechanism 26, and the tray plates are slide due to unbending.

In addition, the bending of the links 28 and 29 has a greater influence on a tray plate 24 on a distal end side than a tray plate 21 on a base end side, and thus the smoothness of the sliding operation of, particularly, the tray plate 24 on the distal end side is impaired, abrupt sliding is caused during the unbending of the links 28 and 29, which is not preferably in terms of the quality of products.

SUMMARY

An advantage of some aspects of the invention is to more smoothly perform operation of individual trays during the expansion and contraction of a multistage type medium receiving portion including a plurality of trays using a driving source such as a motor.

According to an aspect of the invention, there is provided a recording apparatus including an apparatus main body that includes a recording unit which performs recording on a medium, a medium receiving portion that includes a plurality of trays capable of being displaced in a medium discharging direction and becomes a storage state in which at least some of the plurality of trays are stored in the apparatus main body or a development state in which at least one of the plurality of trays is displaced in the medium discharging direction more than in the storage state and receives the medium, a driving source that drives the medium receiving portion, and a transmission unit that transmits power of the driving source to the medium receiving portion, in which the plurality of trays includes at least a first tray and a second tray which is positioned on a downstream side of the first tray in the medium discharging direction in the development state, and the transmission unit includes a first rotating body which comes into contact with the first tray and transmits the power of the driving source to the first tray and a second rotating body which comes into contact with the second tray and transmits the power of the driving source to the second tray.

In this case, the transmission unit includes the first rotating body which comes into contact with the first tray and transmits the power of the driving source to the first tray and the second rotating body which comes into contact with the second tray and transmits the power of the driving source to the second tray, and thus the rotation power of the driving source is directly transmitted to the respective trays, and thus it is possible to smoothly perform the displacement operation of the respective trays, and, particularly, also smoothly displace a tray (second tray) positioned on the downstream side in the development state.

Also, the plurality of trays is not always configured of two of the first and second trays and may be configured of three or more trays, and, in this case, the first and second trays refer to a relationship between a certain tray in the development state and a tray positioned on the downstream side.

In the recording apparatus, the first rotating body comes into contact with a side surface of the first tray, and the second rotating body comes into contact with a side surface of the second tray.

In this case, the first rotating body is configured to come into contact with the side surface of the first tray, that is, configured to come into contact with the highly stiff side surface, and thus it is possible to suppress the deformation of the first tray when the first rotating body comes into contact with the first tray. This is also same for the relationship between the second rotating body and the second tray.

In the recording apparatus, the development state includes a first development state in which only the second tray is displaced in the medium discharging direction from the storage state while the first tray remains at a position in the storage state and a second development state in which the second tray is displaced in the medium discharging direction from the first development state, and, in the transmission unit, the second rotating body comes into contact with the second tray when the medium receiving portion transits from the storage state to the first development state, and the first rotating body comes into contact with the first tray when the medium receiving portion transits from the first development state to the second development state.

In this case, it is possible to smoothly switch the state of the medium receiving portion from the storage state to the development state.

In the recording apparatus, in the transmission unit, the first rotating body comes into contact with the first tray when the medium receiving portion transits from the second development state to the first development state, and the second rotating body comes into contact with the second tray when the medium receiving portion transits from the first development state to the storage state.

In this case, it is possible to transit the medium receiving portion from the development state to the storage state by a reverse operation during the transition from the storage state to the development state.

In the recording apparatus, the transmission unit includes a first rack portion including a plurality of teeth on a side surface of the first tray, a second rack portion including a plurality of teeth on a side surface of the second tray, and a pinion portion in which a first gear, as the first rotating body, which engages the teeth of the first rack portion, and a second gear, as the second rotating body, which engages the teeth of the second rack portion are disposed on the same rotating shaft.

In this case, it is possible to simply realize the configuration of the recording apparatus using the rack and pinion mechanism.

In the recording apparatus, the pinion portion includes an elastic member that allows rotation of the second gear with respect to the first gear in a certain range, between the first gear and the second gear.

In this case, the pinion portion includes the elastic member that allows the rotation of the second gear with respect to the first gear in a certain range between the first gear and the second gear, and thus it is possible to suppress or avoid phase deviation between the first gear and the second gear.

In the recording apparatus, the first tray includes a first portion to be contacted and a second portion to be contacted which are provided in the medium discharging direction at an interval, and the second tray includes a regulating unit which comes into contact with the first portion to be contacted so as to regulate movement of the second tray with respect to the first tray in a development direction to a predetermined extent and comes into contact with the second portion to be contacted so as to regulate movement of the second tray with respect to the first tray in a storage direction to a predetermined extent.

In this case, it is possible to have a configuration in which the second tray is advanced or retreated with respect to the first tray in a predetermined range.

In the recording apparatus, the first tray includes a first portion to be contacted and a second portion to be contacted which are provided in the medium discharging direction at an interval, the second tray includes a regulating unit which comes into contact with the first portion to be contacted so as to regulate movement of the second tray with respect to the first tray in a development direction to a predetermined extent and comes into contact with the second portion to be contacted so as to regulate movement of the second tray with respect to the first tray in a storage direction to a predetermined extent, and the first portion to be contacted and the regulating unit, and the second portion to be contacted and the regulating unit come into contact with each other, respectively at a position at which phases match of the first rack portion and the teeth of the first gear are matched and phases of between the second rack portion and the teeth of the second gear are matched.

In this case, it is possible to match the phases of the first rack portion and the second rack portion in a state in which the movement of the second tray with respect to the first tray is regulated.

In the recording apparatus, a distal end side of the first rack portion in the medium discharging direction and a rear end side of the second rack portion in the medium discharging direction overlap each other when the regulating unit comes into contact with the first portion to be contacted, and at least one of the distal end side of the first rack portion and the rear end side of the second rack portion is formed so that the teeth become lower stepwise toward an end portion side.

In this case, it is possible to facilitate the matching of the phases of the first rack portion and the second rack portion.

In the recording apparatus, the transmission unit includes a friction clutch between the driving source and the first rotating body and between the driving source and the second rotating body, respectively.

In this case, it is possible to manually switch a state to the storage state and the development state of the medium receiving portion.

In the recording apparatus, the second tray includes a first slit which is open on an end portion side on an upstream side in the medium discharging direction and is extended along the second rack portion, and the side surface side provided with the second rack portion is configured to be elastically deformable in a direction in which an opening width of the first slit narrows.

For example, when the phases of the second rack portion and the second gear are not matched with each other, there are cases in which the teeth of the second gear come into contact with the teeth of the second rack portion and are locked.

In this case, it is possible to configure that, in a case in which the teeth of the second gear come into contact with the teeth of the second rack portion, the side surface side provided with the second rack portion elastically deforms and avoids in the direction in which the opening width of the first slit narrows. When the side surface side elastically deforms, it becomes easy to cause the second rack portion to mesh with the teeth of the second gear, and it is possible to suppress a disadvantage of the second gear being locked.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

First, an outline of a recording apparatus according to an example of the invention will be described. In the embodiment, an ink jet printer 1 (hereinafter, simply referred to as a printer 1) is exemplified as an example of the recording apparatus.

Figure 1:
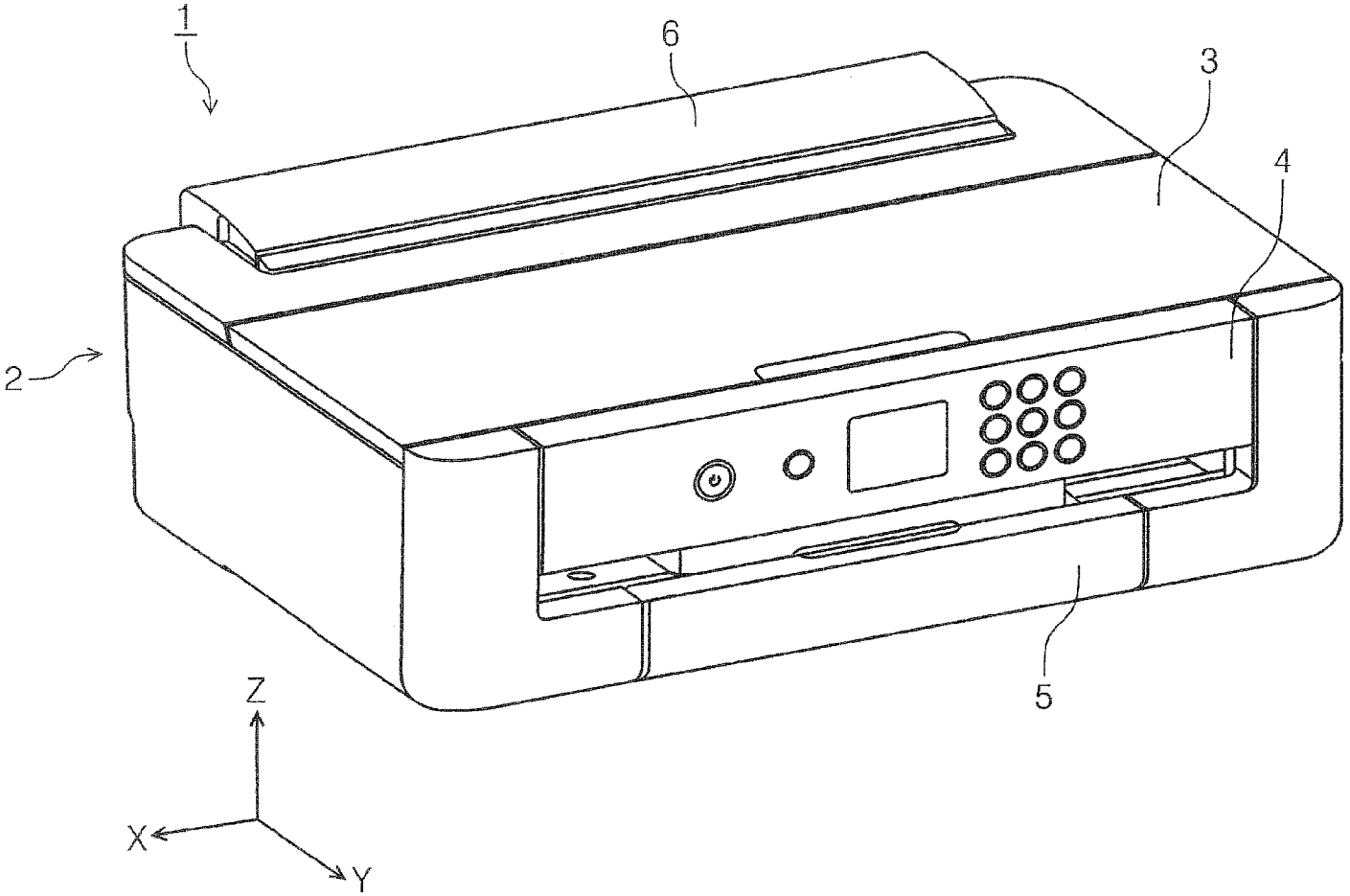
FIG. 1 is a view of an exterior perspective view of a printer according to the invention, and illustrates a storage state of a paper discharging tray.
Figure 2:
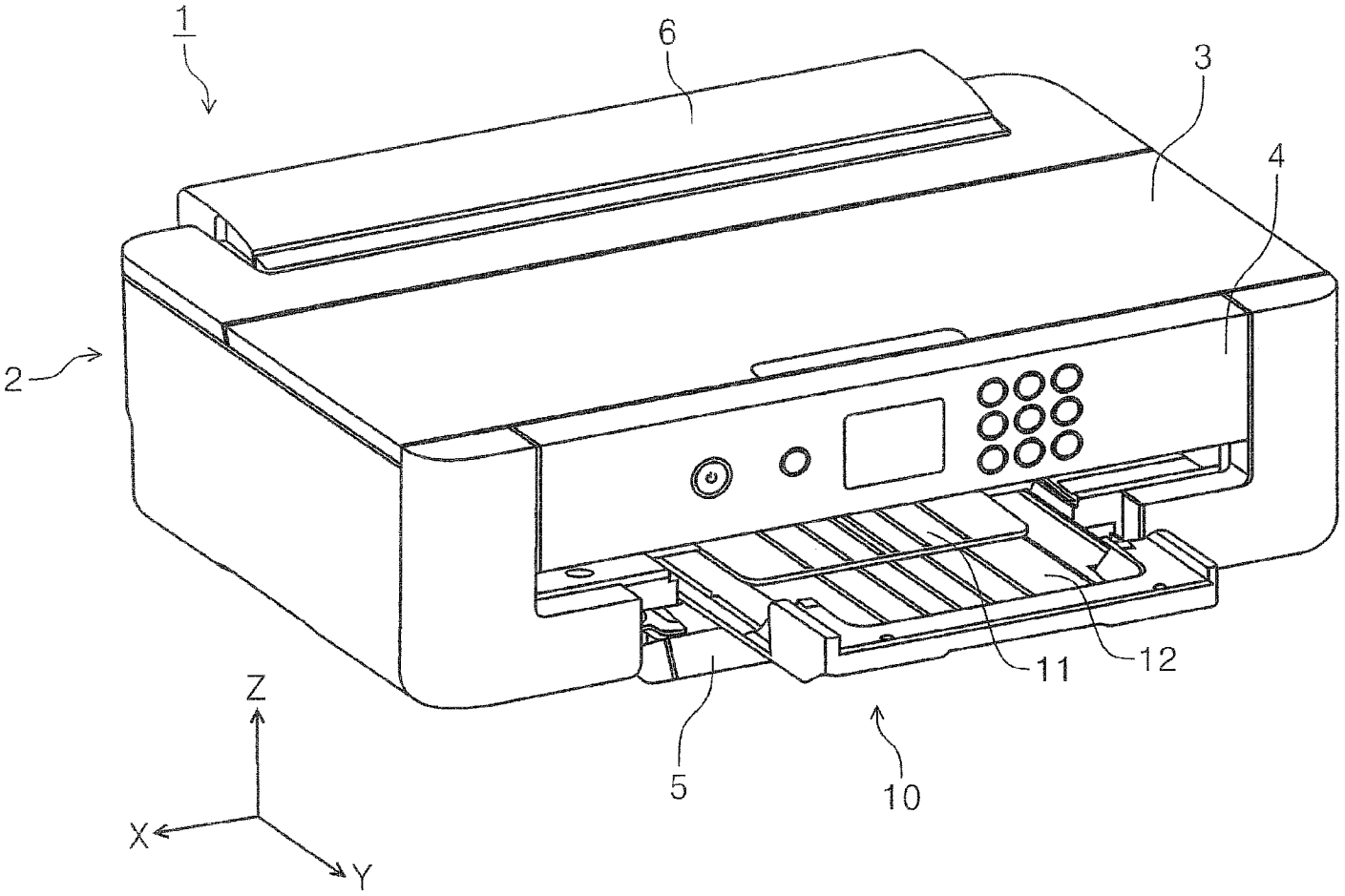
FIG. 2 is a view illustrating a first development state of the paper discharging tray in the printer according to the invention.
Figure 3:
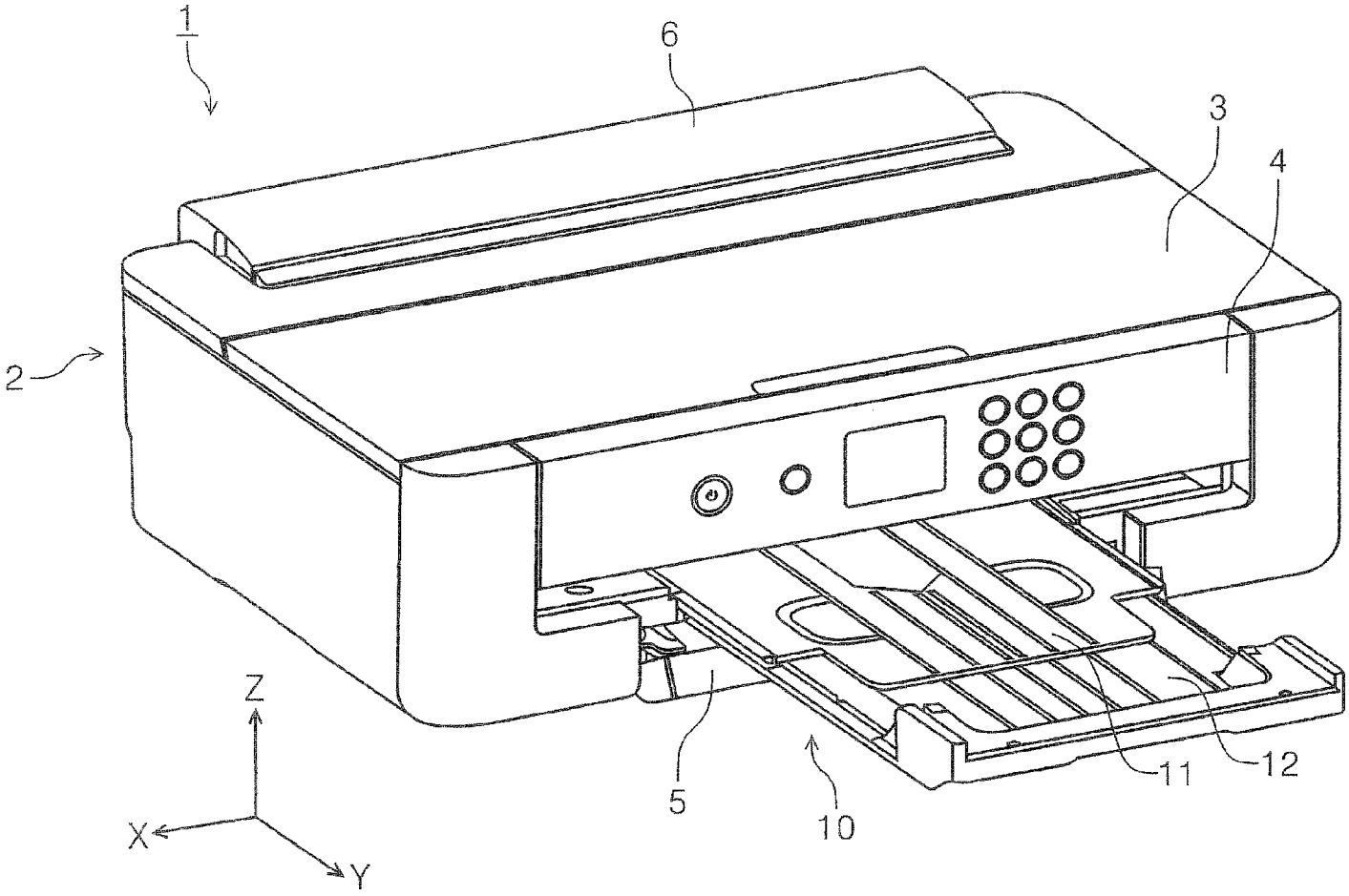
FIG. 3 is a view illustrating a second development state of the paper discharging tray in the printer according to the invention.
Figure 4:
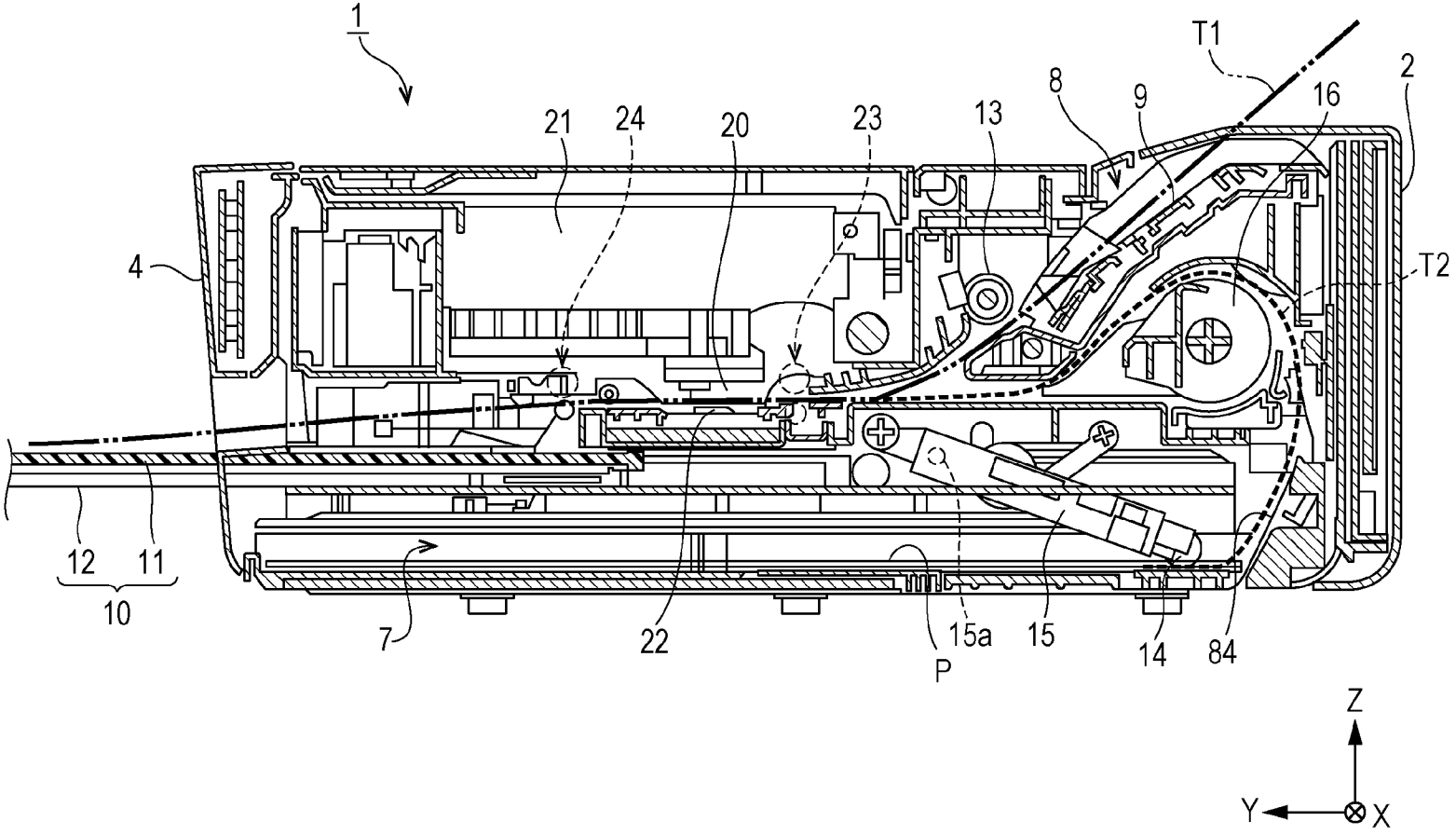
FIG. 4 is a view illustrating a paper transporting passage of the printer according to the invention.
Figure 5:
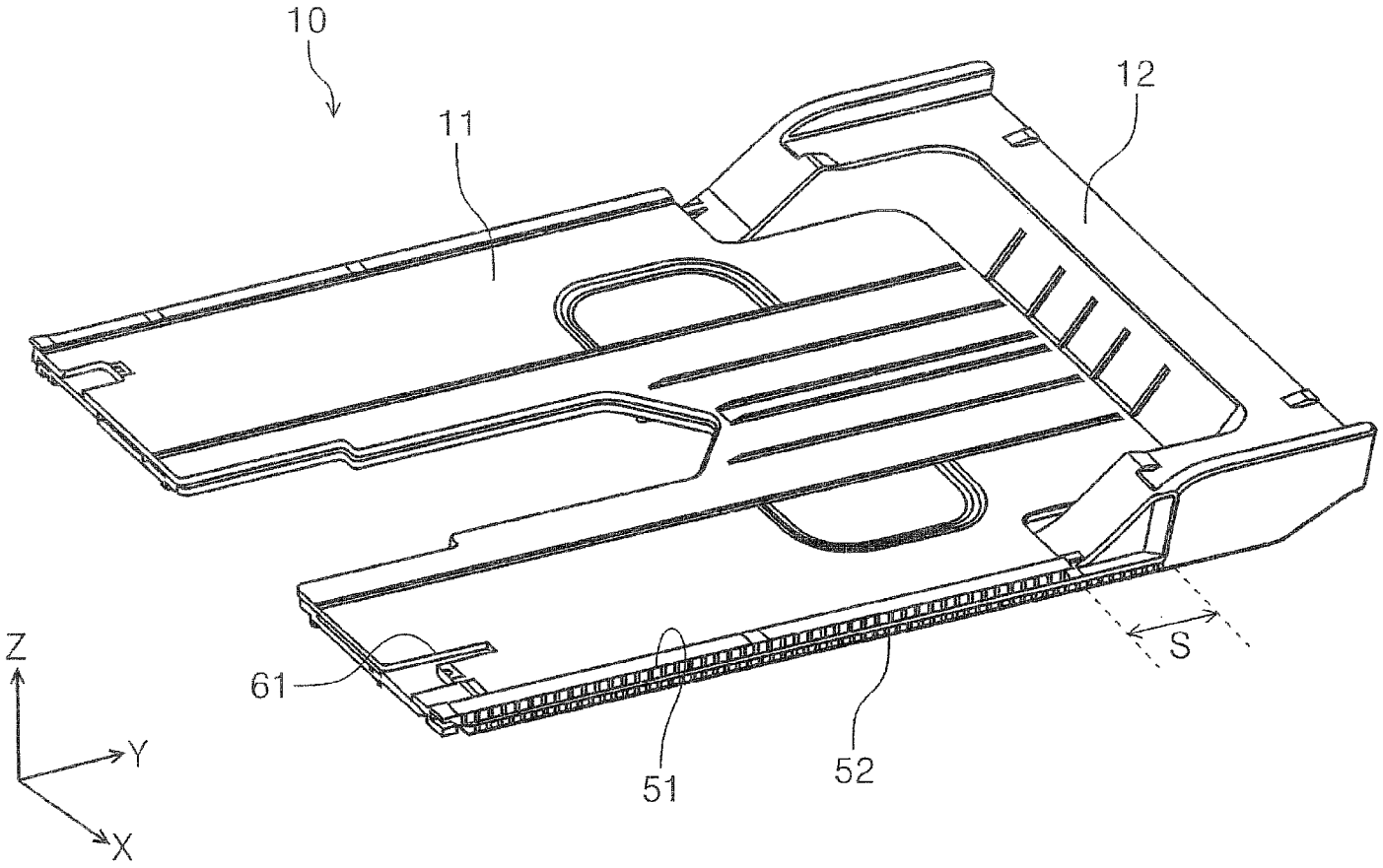
FIG. 5 is an exterior perspective view of the paper discharging tray.
Figure 6:
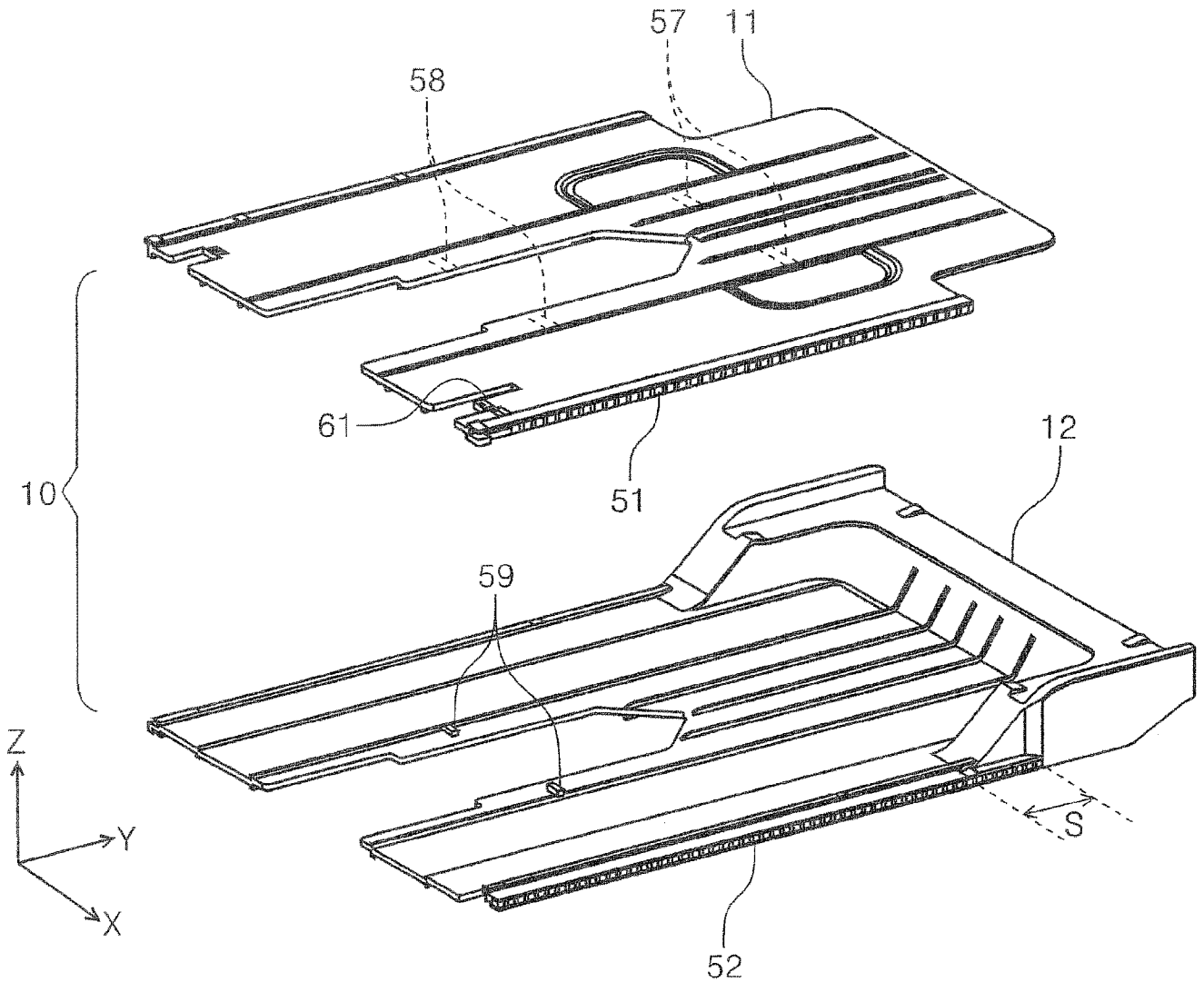
FIG. 6 is an exploded perspective view of the paper discharging tray.
Figure 7:
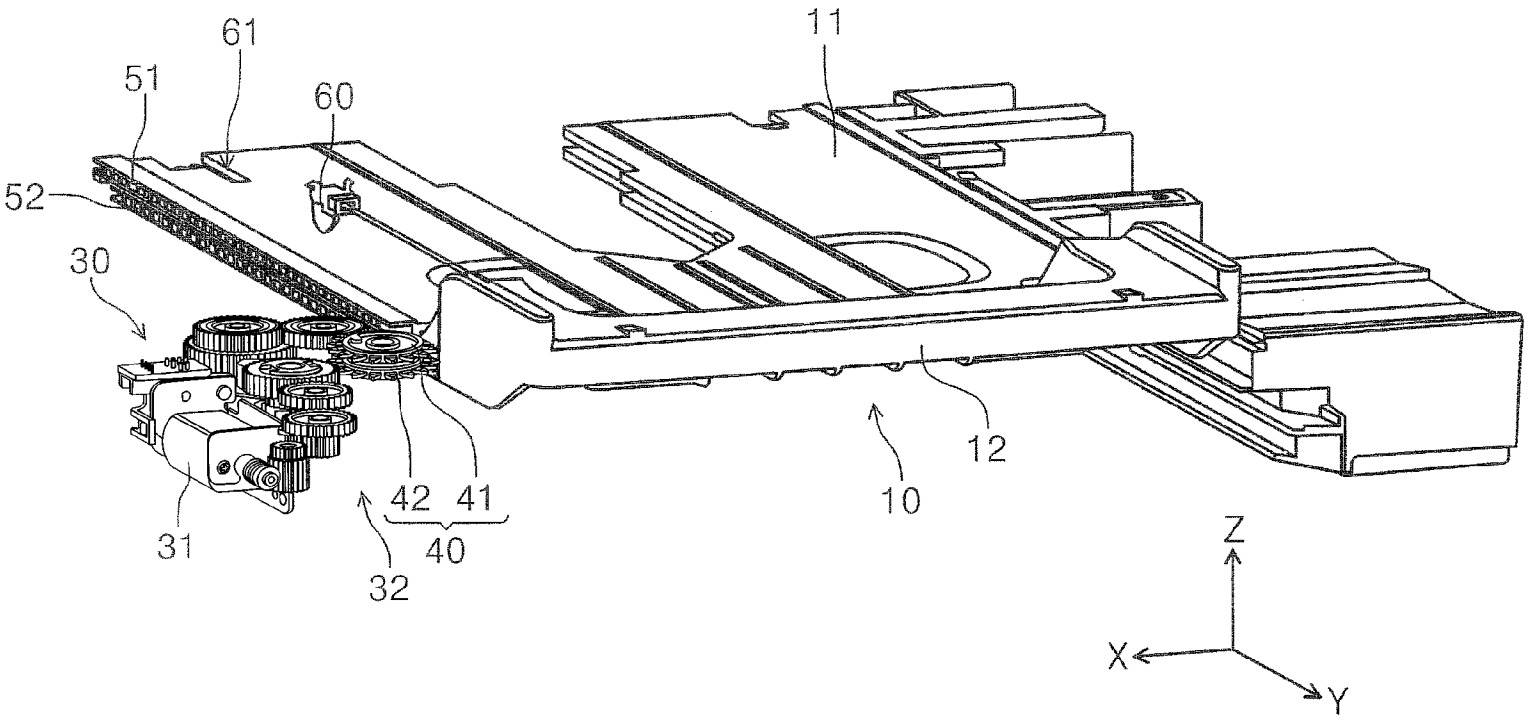
FIG. 7 is a perspective view illustrating the paper discharging tray in the storage state.
Figure 8:
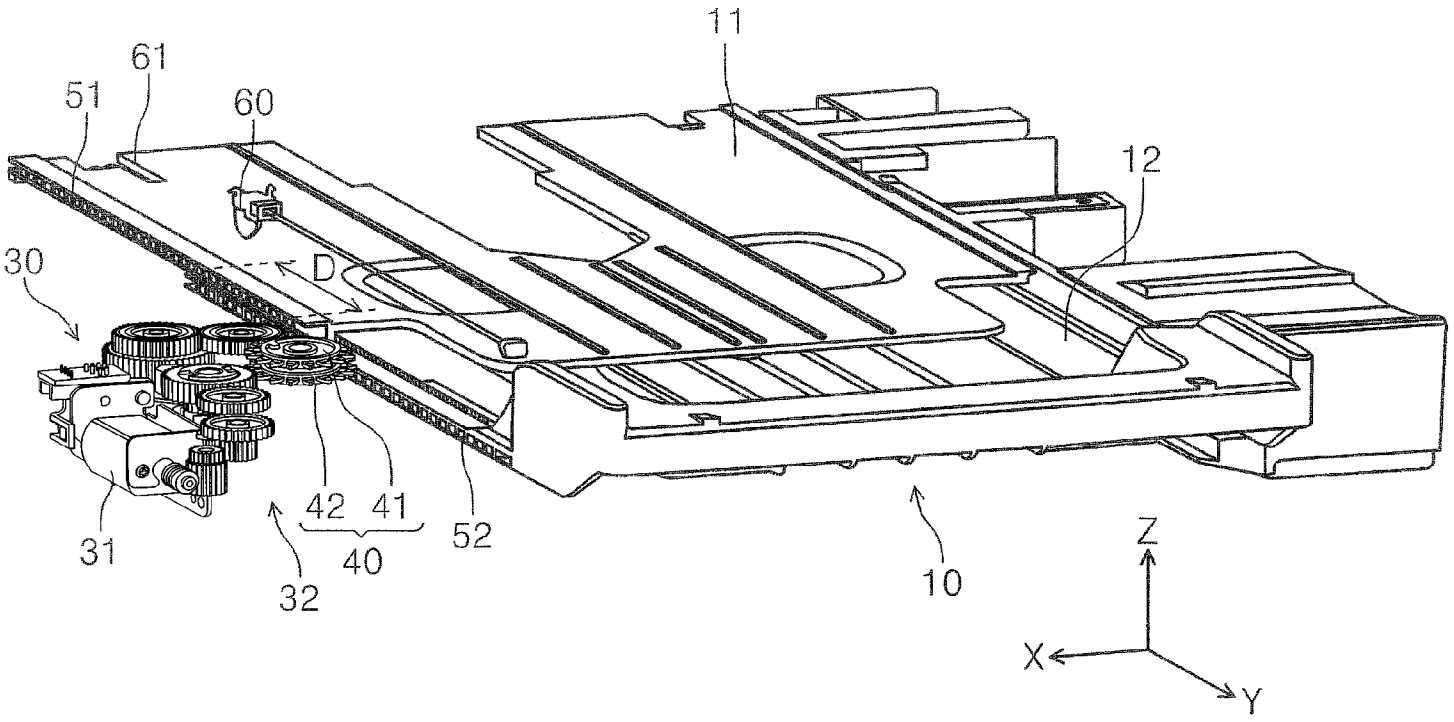
FIG. 8 is a perspective view illustrating the paper discharging tray in the first development state.
Figure 9:
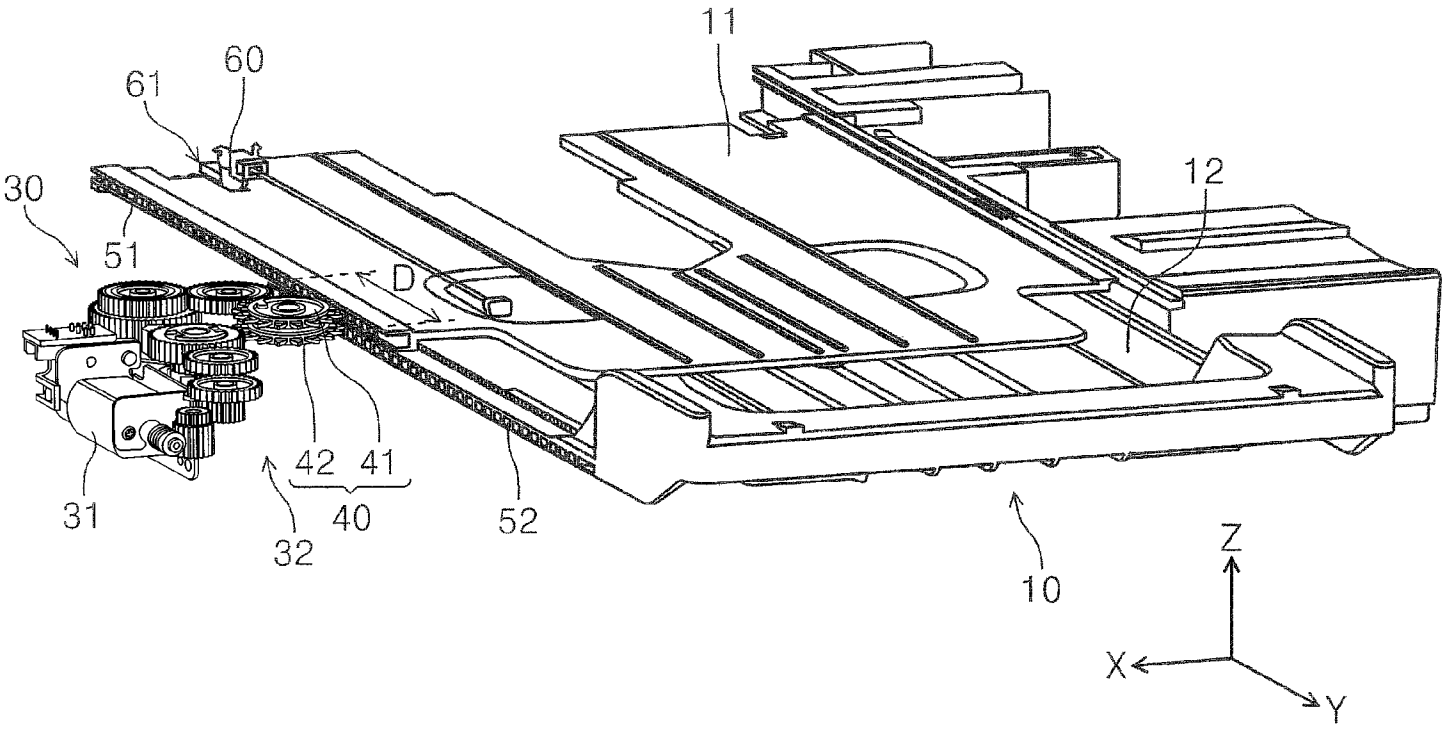
FIG. 9 is a perspective view illustrating the paper discharging tray between the first development state and the second development state.
Figure 10:
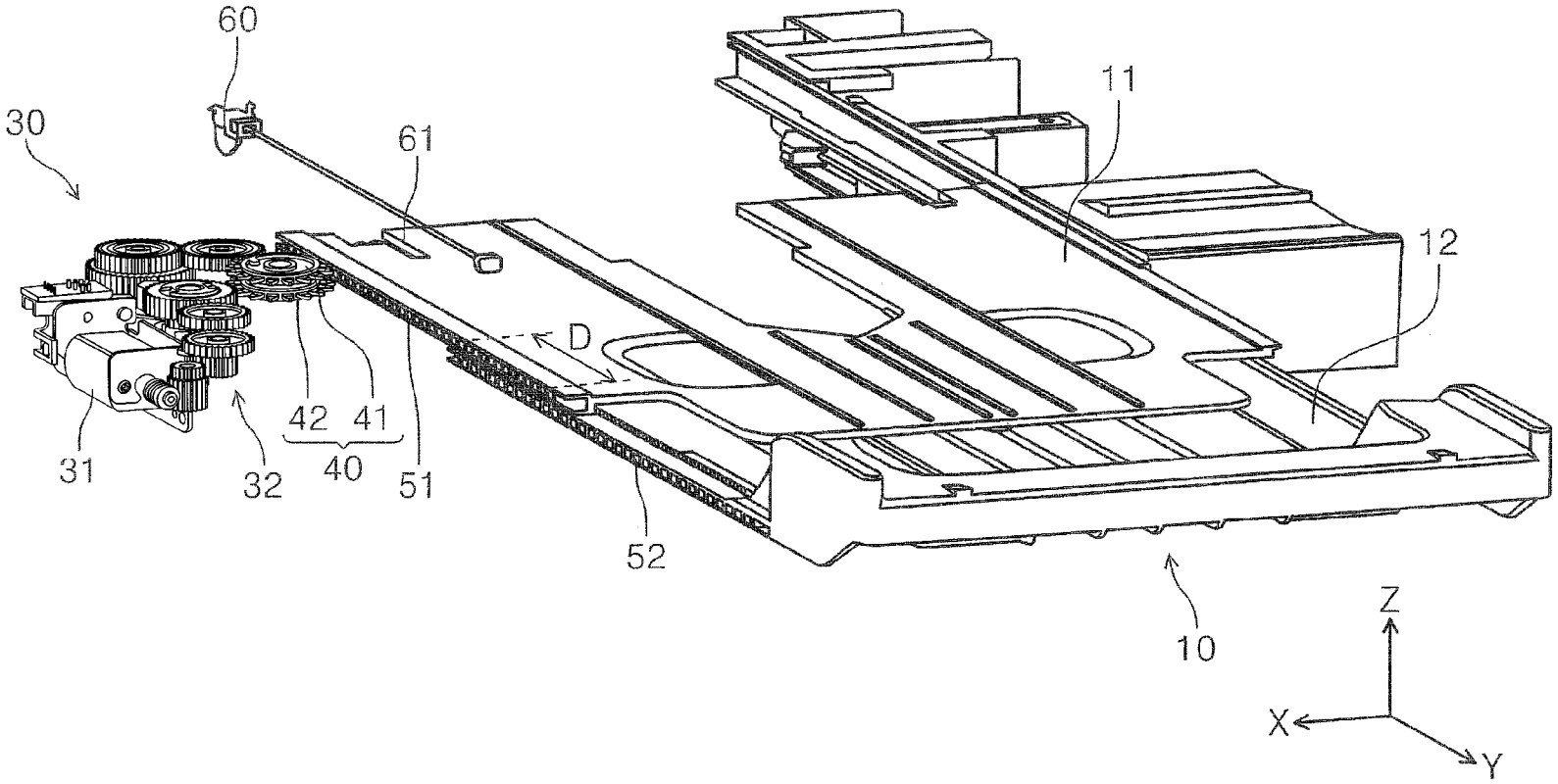
FIG. 10 is a perspective view illustrating the paper discharging tray in the second development state.
Figure 11:
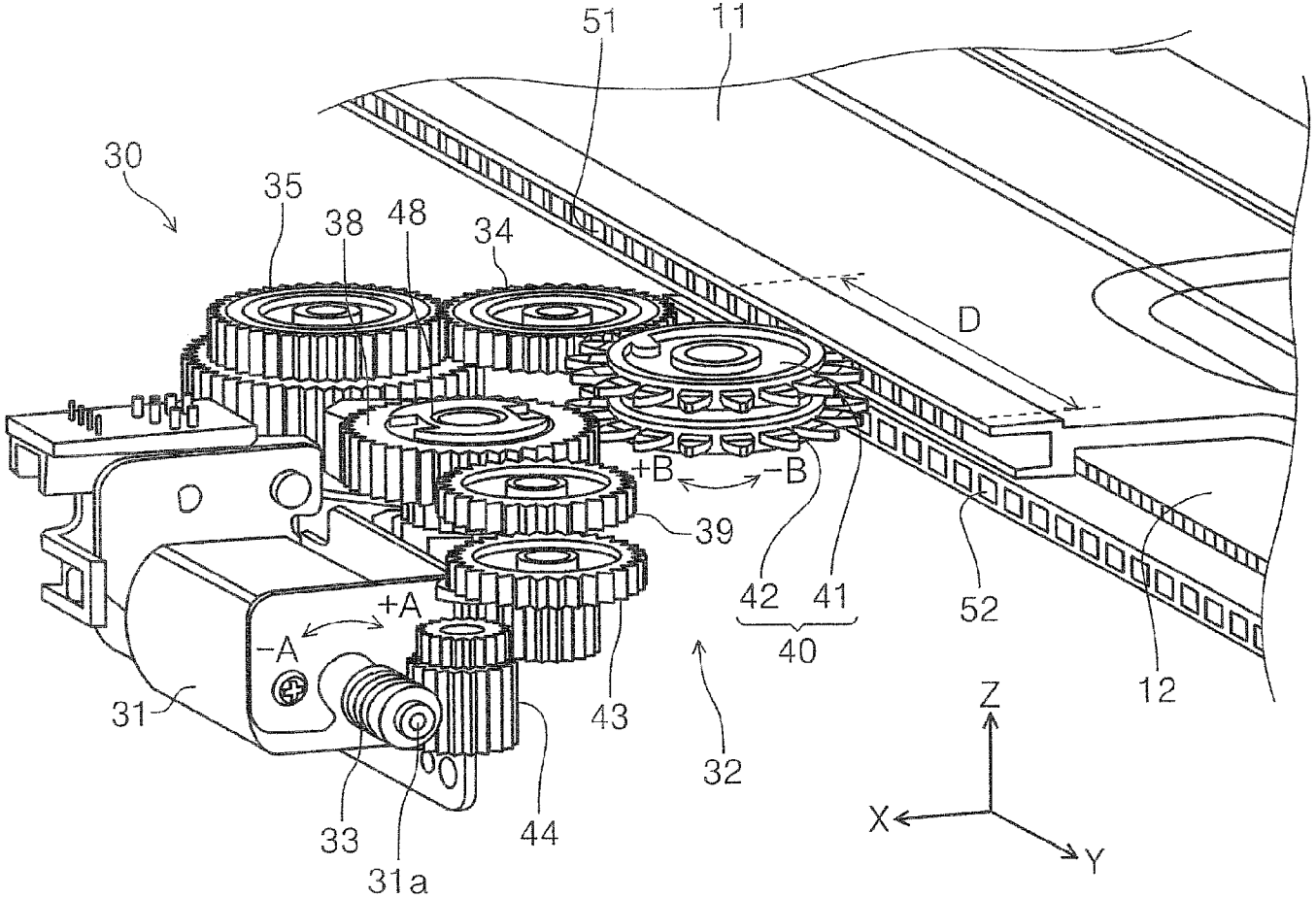
FIG. 11 is a perspective view illustrating a driving mechanism of the paper discharging tray.
Figure 12:
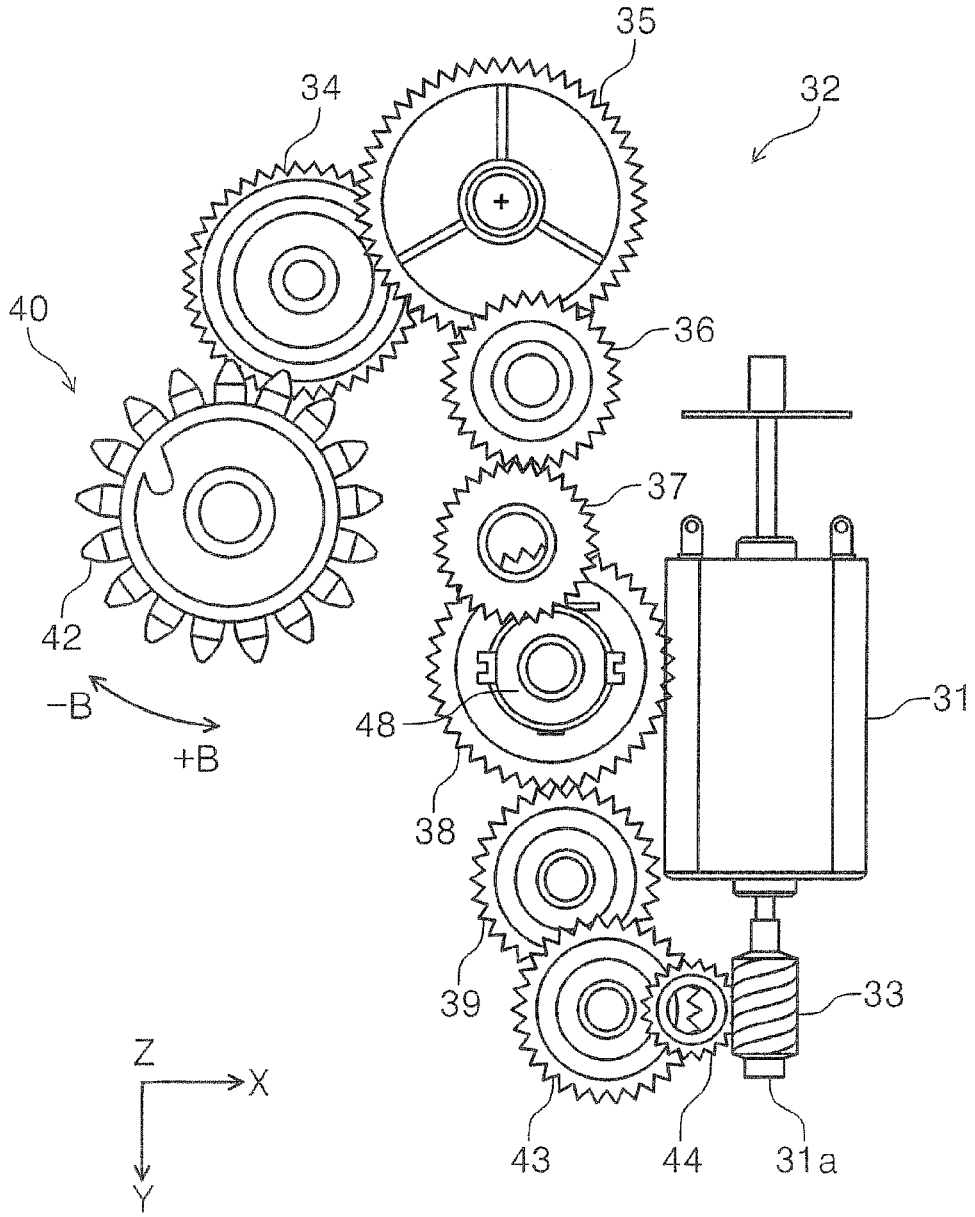
FIG. 12 is a view of the driving mechanism of the paper discharging tray when seen from the bottom.

FIG. 1 is an exterior perspective view of the printer according to the aspect of the invention, and is a view illustrating a storage state of a paper discharging tray. FIG. 2 is a view illustrating a first development state of the paper discharging tray in the printer according to the aspect of the invention. FIG. 3 is a view illustrating a second development state of the paper discharging tray in the printer according to the aspect of the invention. FIG. 4 is a view illustrating a paper transporting passage of the printer according to the aspect of the invention. FIG. 5 is an exterior perspective view of the paper discharging tray. FIG. 6 is an exploded perspective view of the paper discharging tray. FIG. 7 is a perspective view illustrating the paper discharging tray in the storage state. FIG. 8 is a perspective view of the paper discharging tray in the first development state. FIG. 9 is a perspective view illustrating the paper discharging tray between the first development state and the second development state. FIG. 10 is a perspective view illustrating the paper discharging tray in the second development state. FIG. 11 is a perspective view illustrating a driving mechanism of the paper discharging tray. FIG. 12 is a view of the driving mechanism of the paper discharging tray when seen from a lower side.

Figure 13:
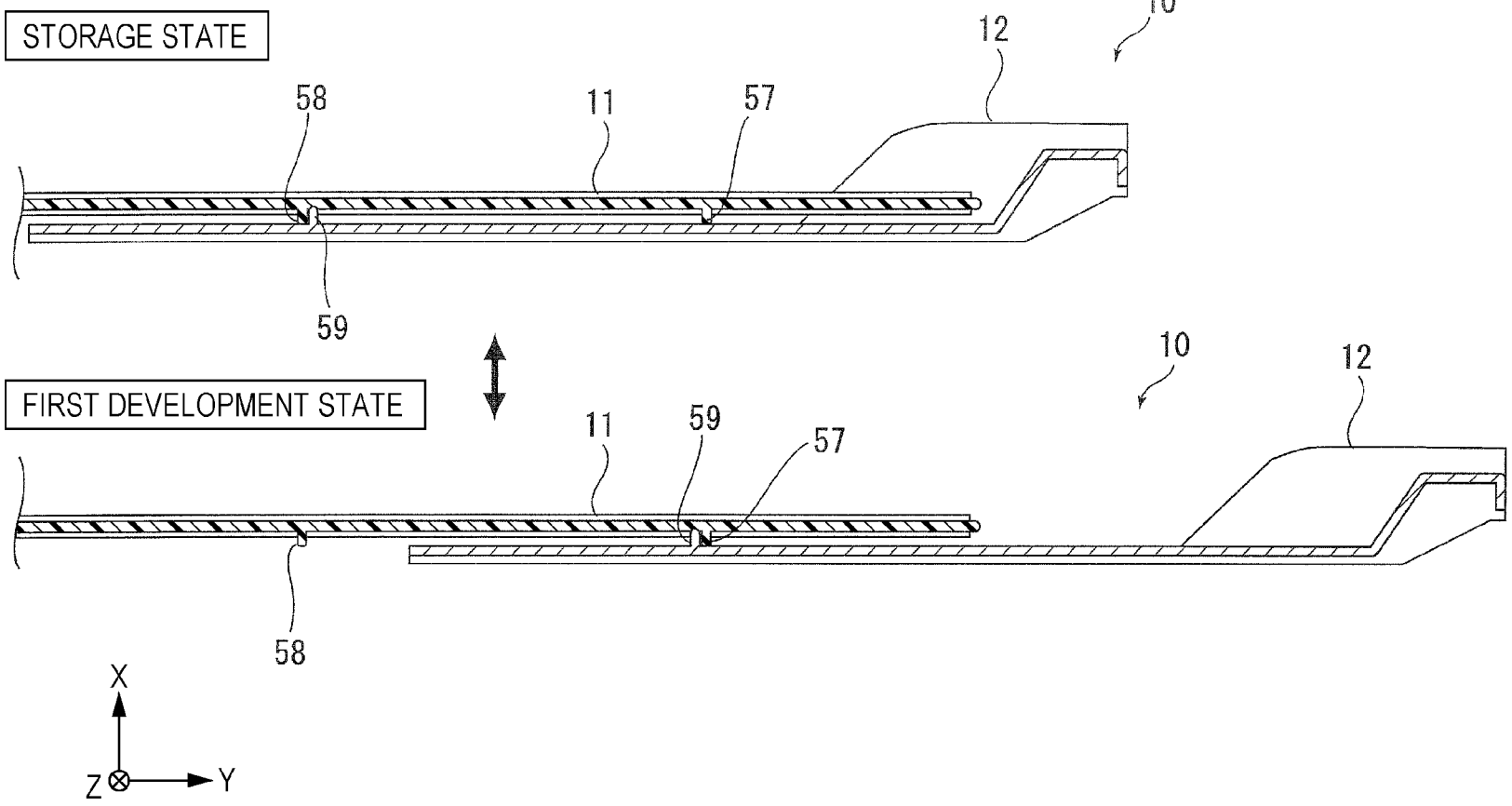
FIG. 13 is a view for describing a regulating unit of the paper discharging tray.
Figure 14:
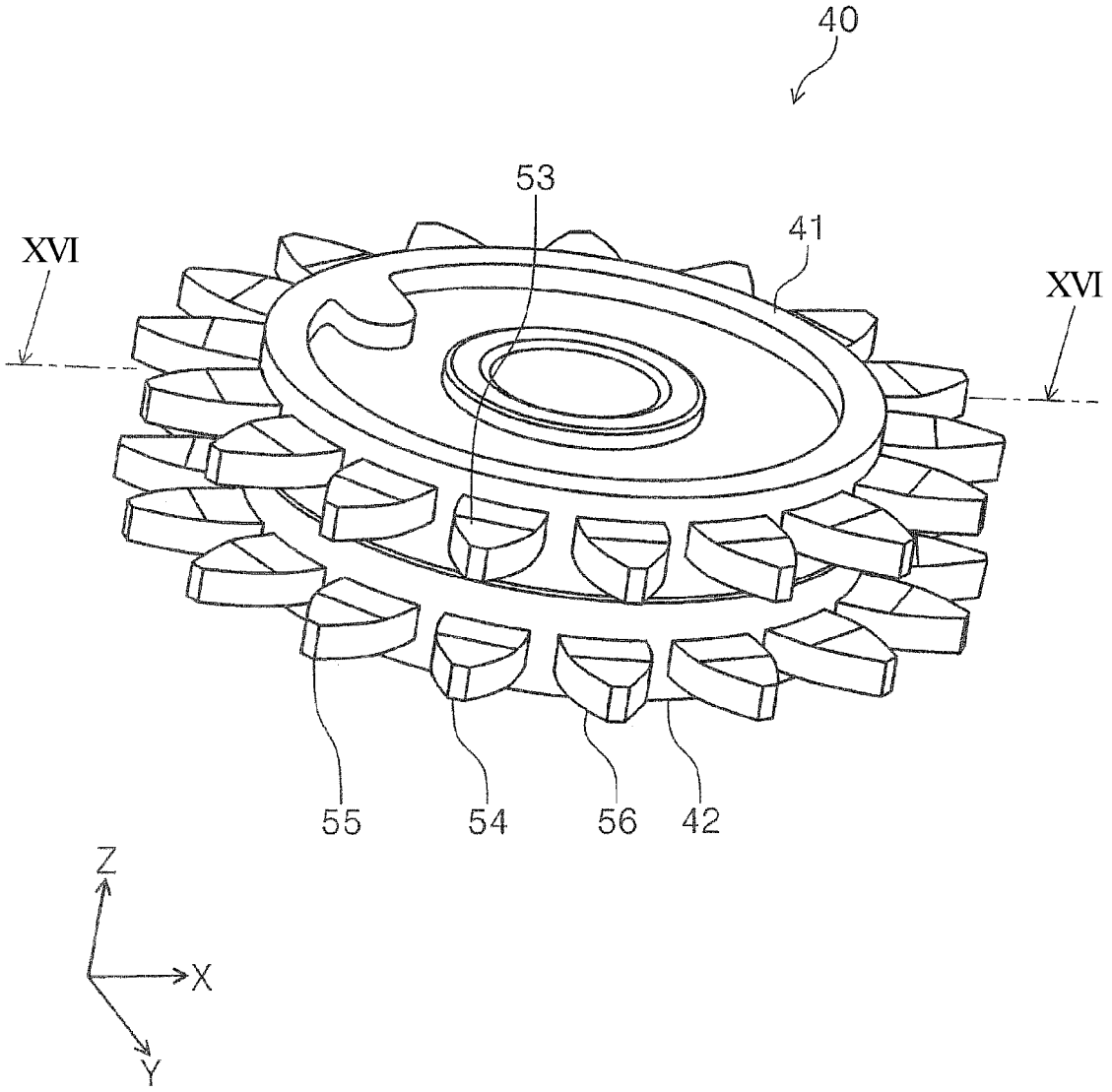
FIG. 14 is an exterior perspective view of a pinion portion.
Figure 15:
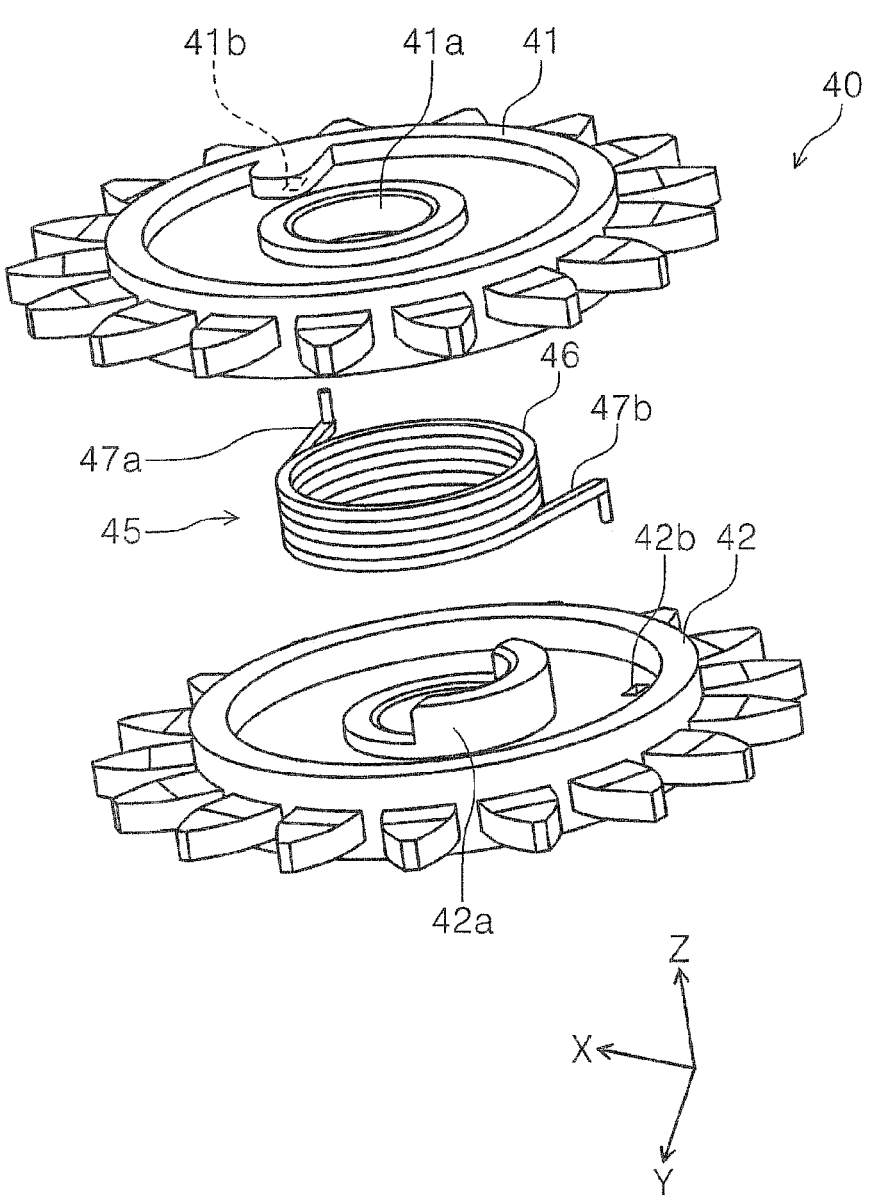
FIG. 15 is an exploded perspective view of the pinion portion.
Figure 16:
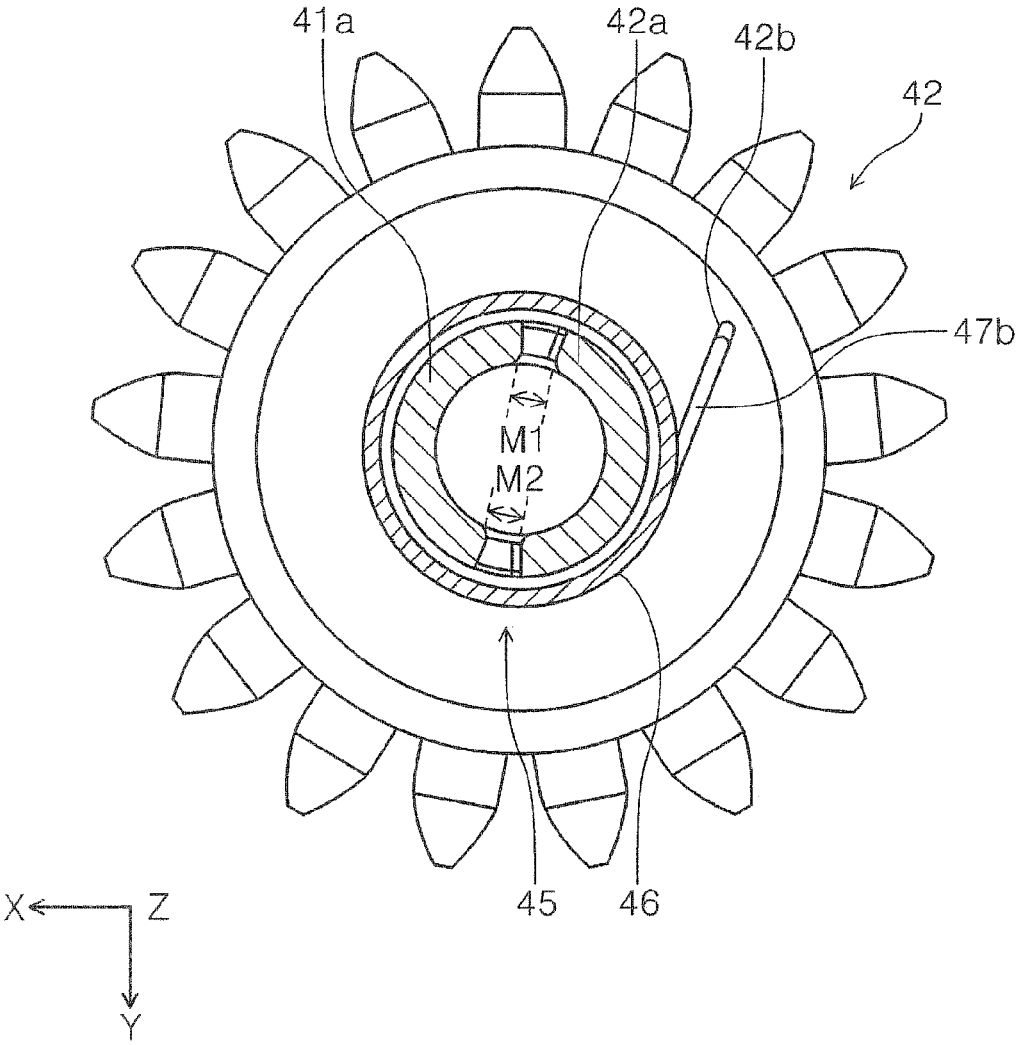
FIG. 16 is a sectional view taken along XVI-XVI line of FIG. 14.
Figure 17:
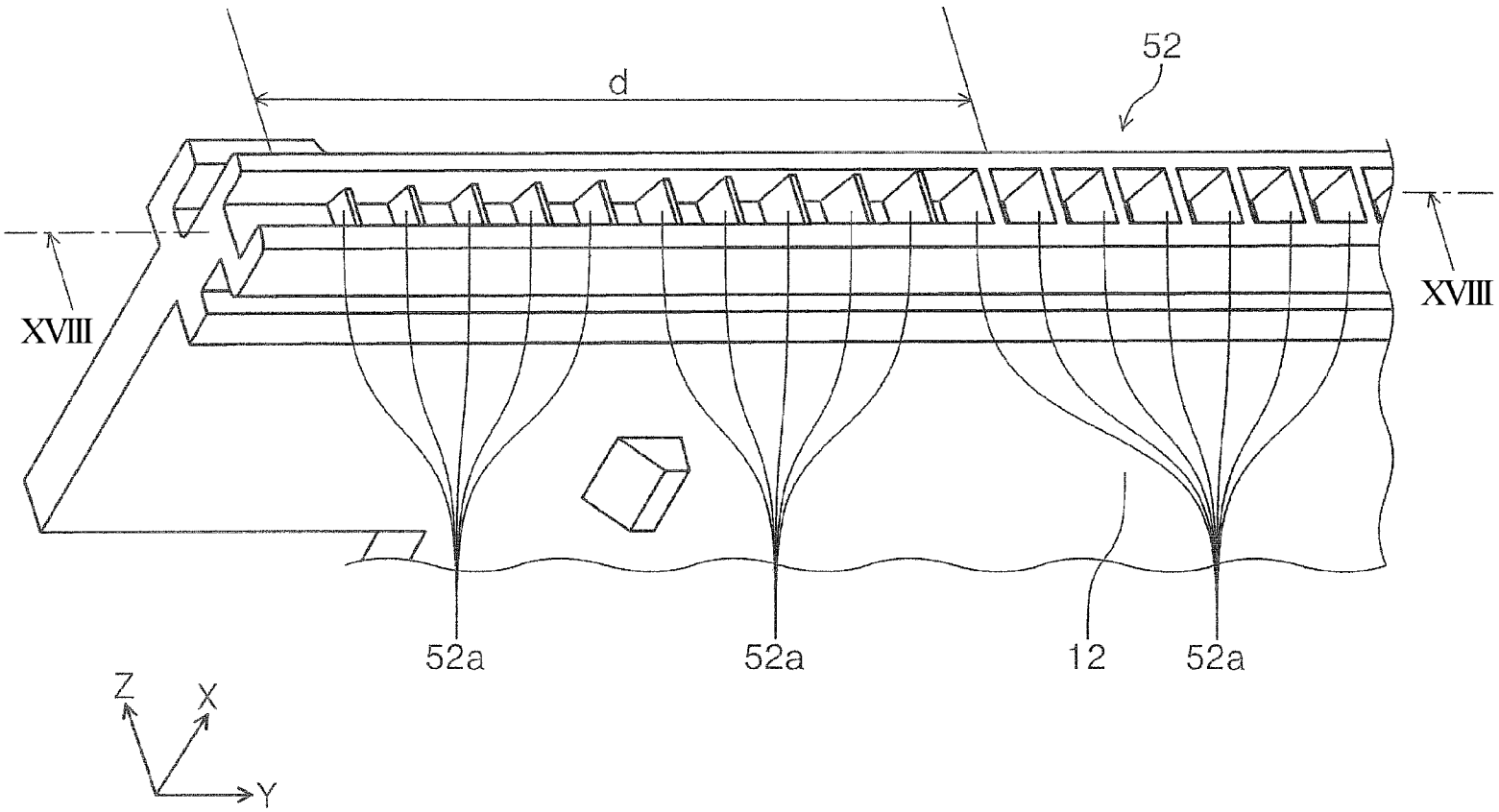
FIG. 17 is a view for describing a modification example of a second rack portion.
Figure 18:
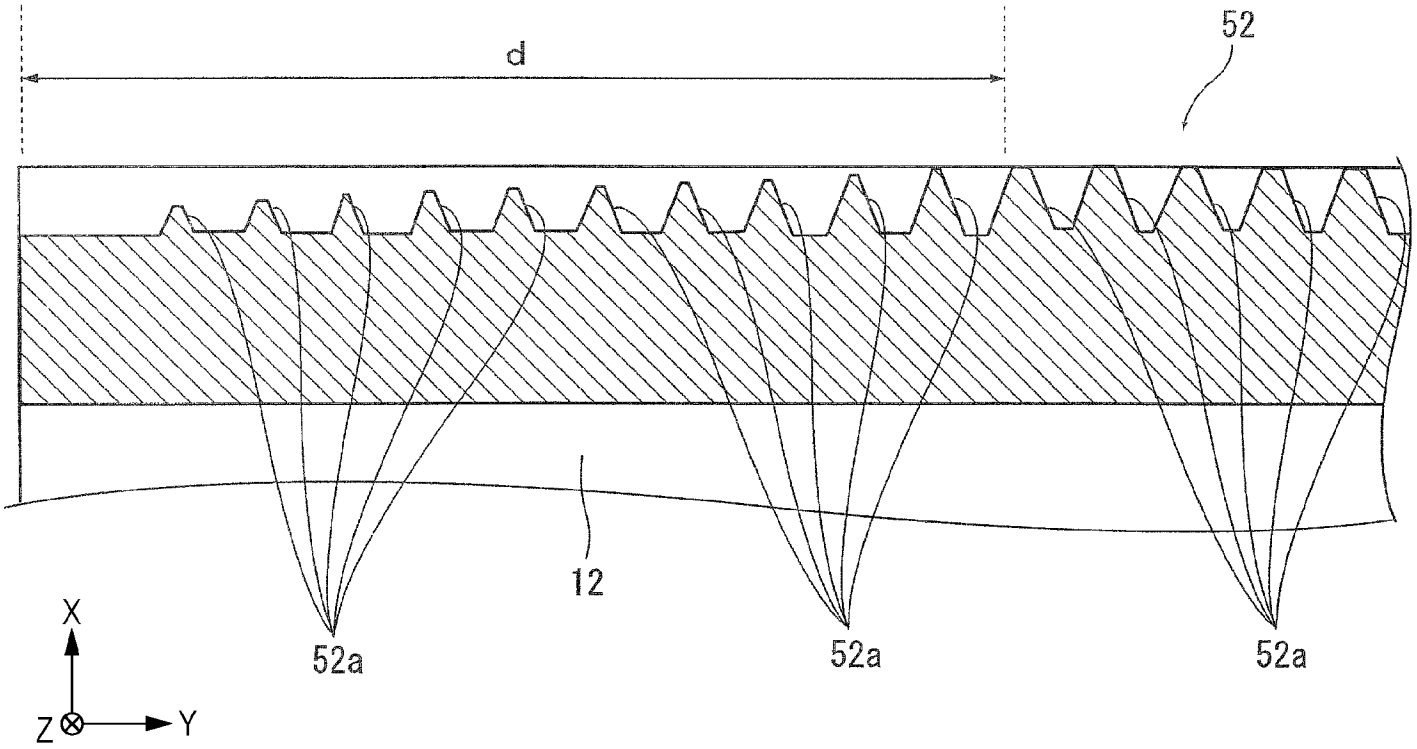
FIG. 18 is a sectional view taken along XVIII-XVIII line of FIG. 17.
Figure 19:
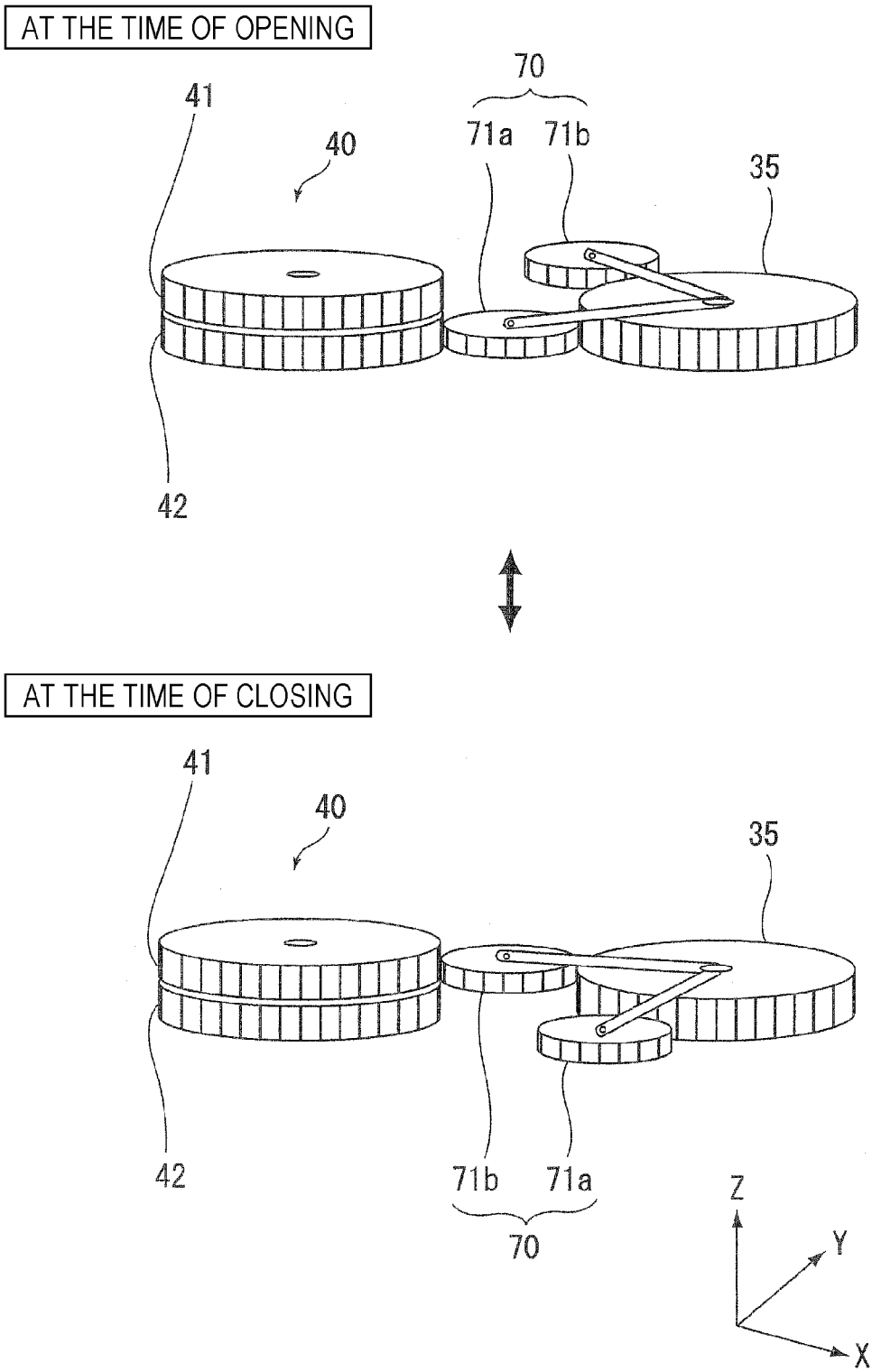
FIG. 19 is a view for describing a modification example of the driving mechanism of the paper discharging tray.
Figure 20:
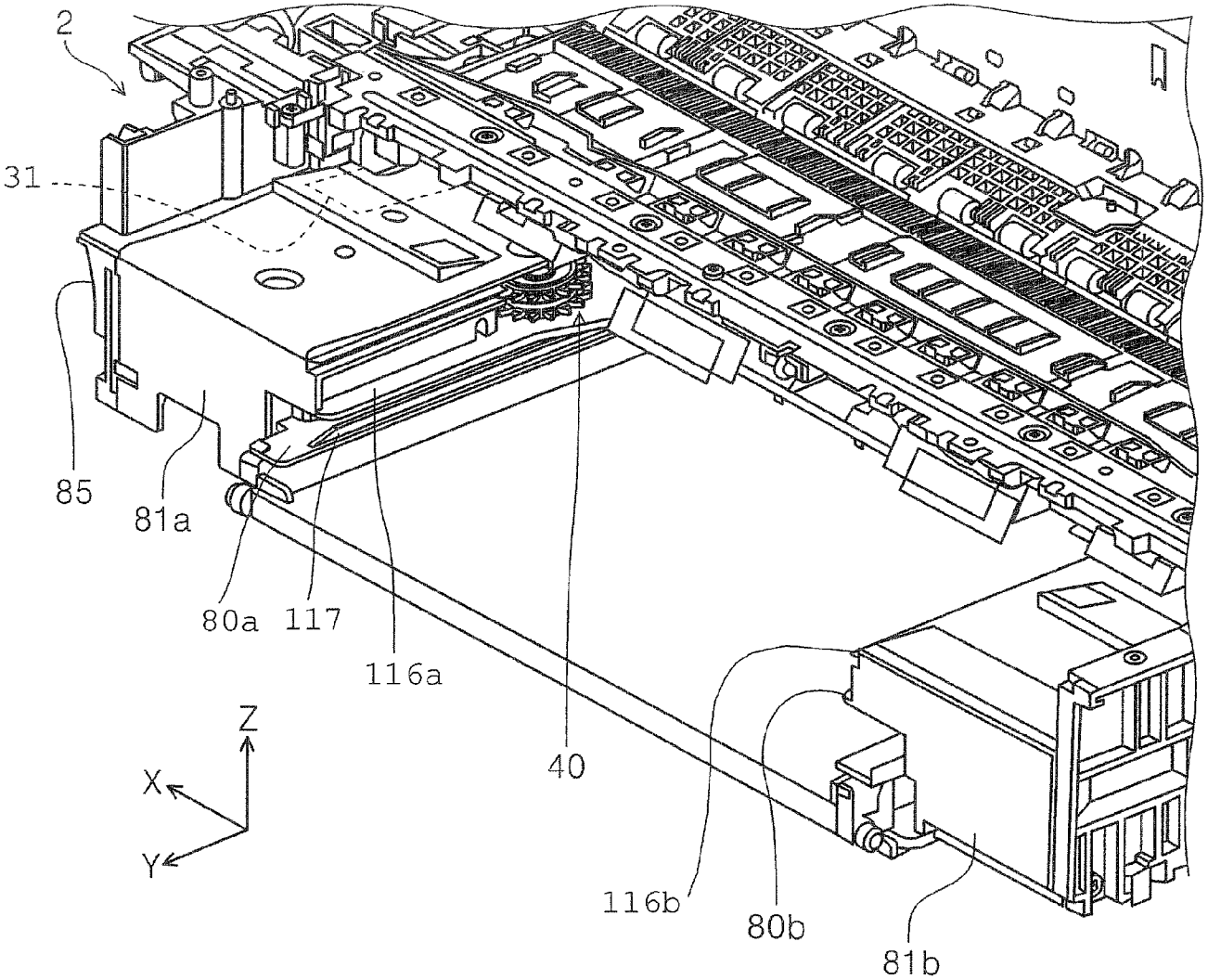
FIG. 20 is a perspective view illustrating a state in which the paper discharging tray is removed from an apparatus main body.
Figure 21:
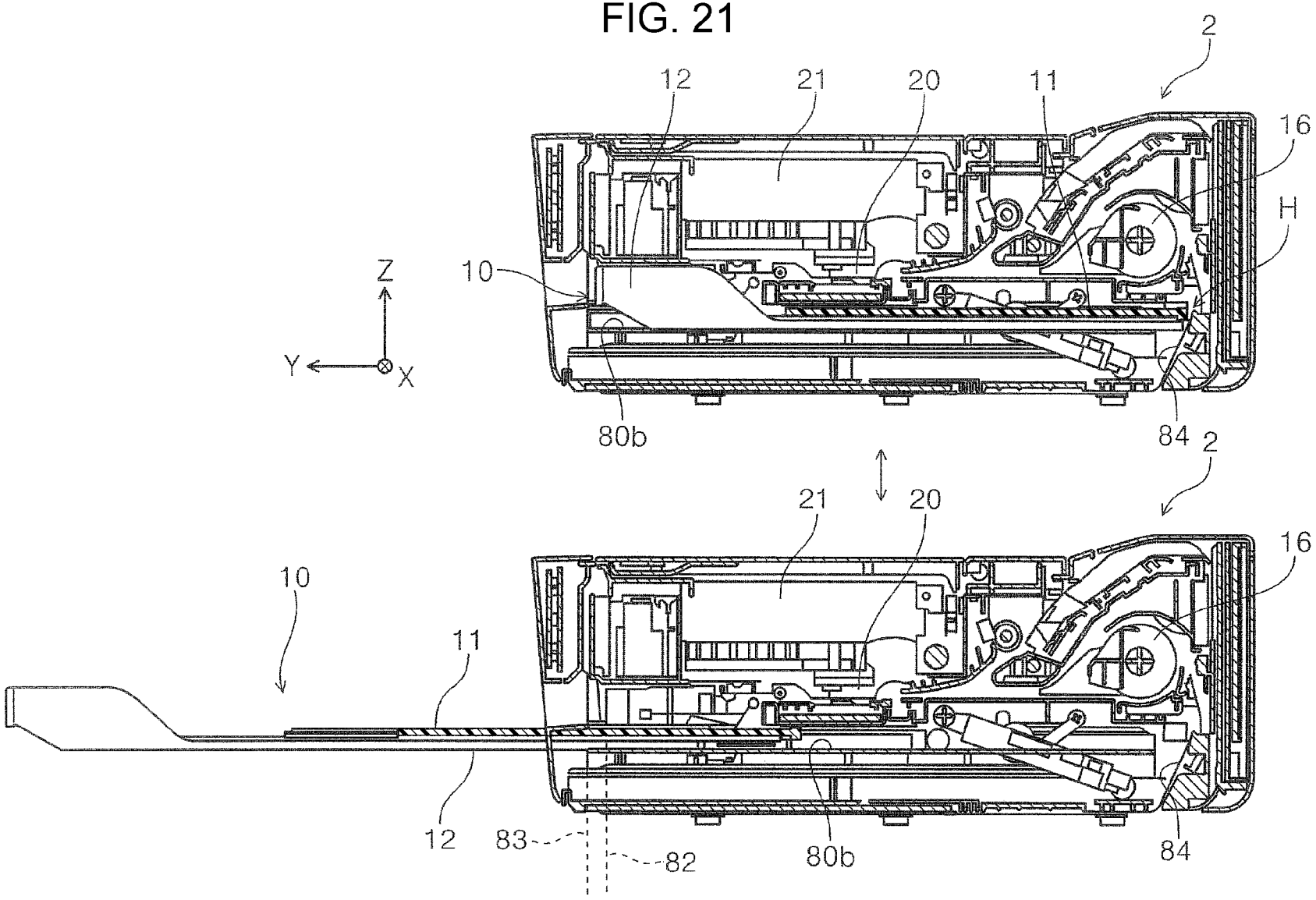
FIG. 21 is a side sectional view illustrating displacement of the paper discharging tray between the storage state and the second development state.
Figure 22:
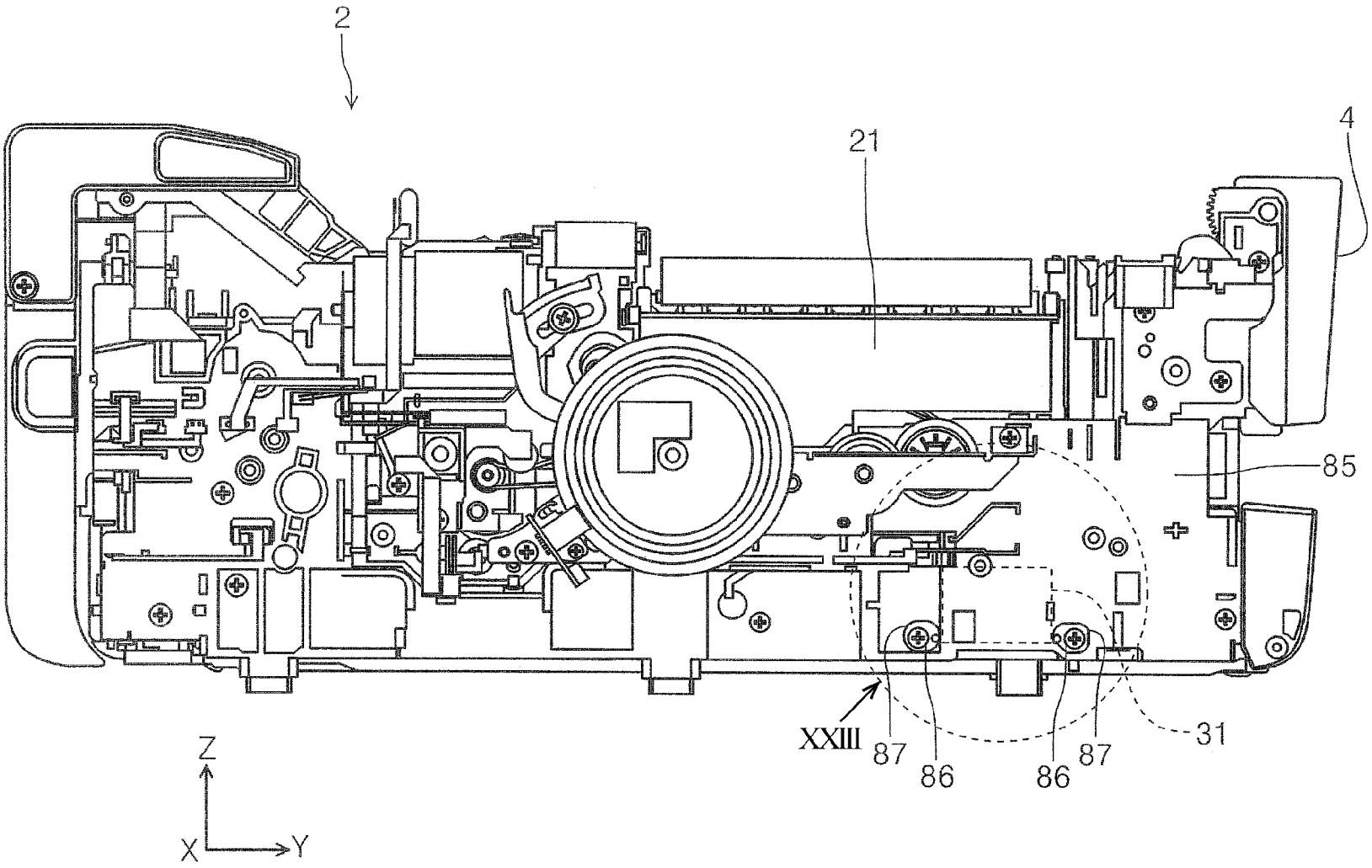
FIG. 22 is a view illustrating a state in which a left side exterior of the apparatus main body is removed.
Figure 23:
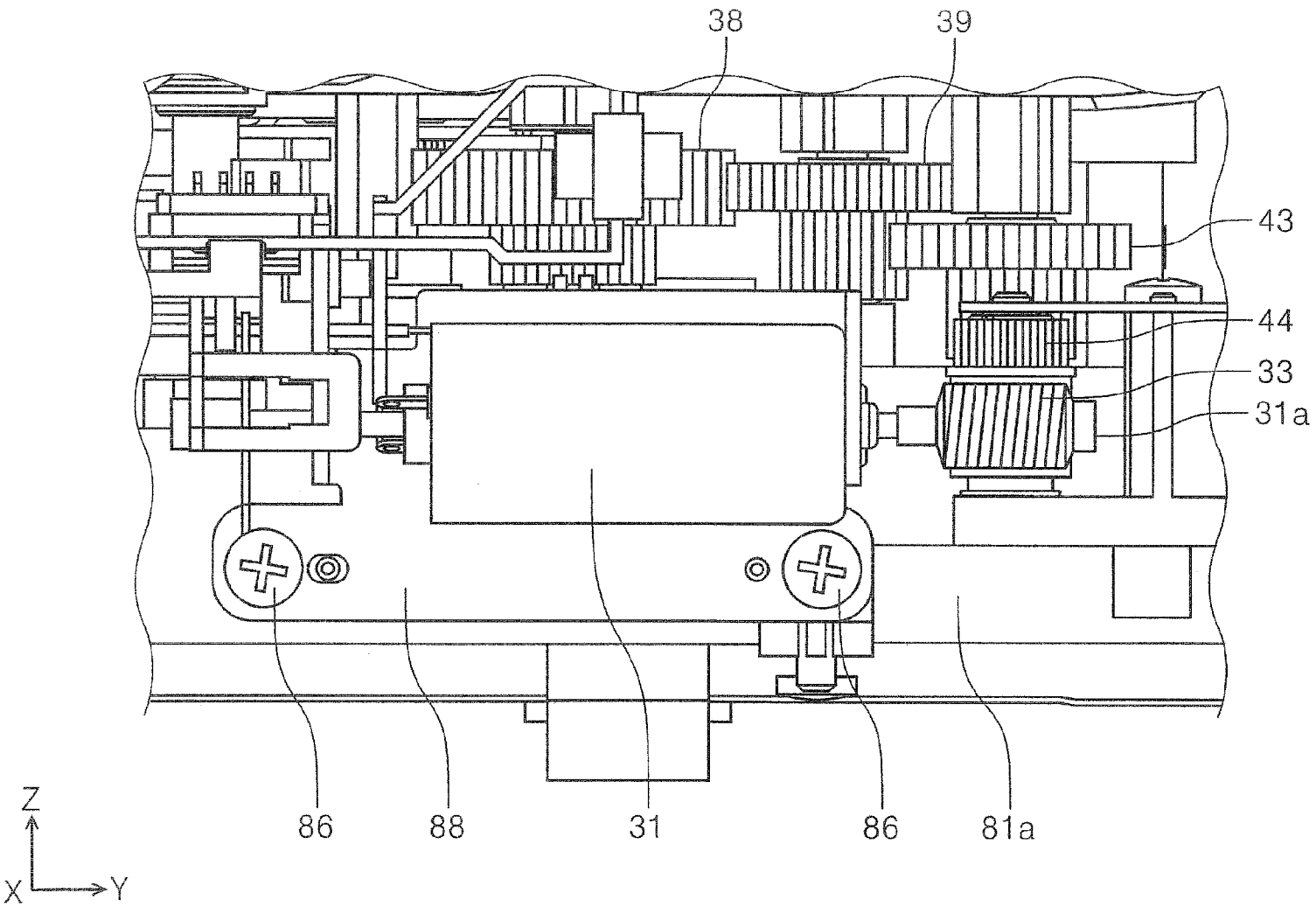
FIG. 23 is an enlarged view of a XXIII part in a state in which a left side base frame is removed in FIG. 22.

FIG. 13 is a view for describing a regulating unit of the paper discharging tray. FIG. 14 is an exterior perspective view of a pinion portion. FIG. 15 is an exploded perspective view of the pinion portion. FIG. 16 is a sectional view taken along XVI-XVI line of FIG. 14. FIG. 17 is a view for describing a modification example of a second rack portion. FIG. 18 is a sectional view taken along XVII-XVII line of FIG. 17. FIG. 19 is a view for describing a modification example of the driving mechanism of the paper discharging tray. FIG. 20 is a perspective view illustrating a state in which the paper discharging tray is removed from an apparatus main body. FIG. 21 is a side sectional view illustrating displacement of the paper discharging tray between the storage state and the second development state. FIG. 22 is a view illustrating a state in which a left side exterior of the apparatus main body is removed. FIG. 23 is an enlarged view of a XXIII part in a state in which a left side base frame is removed in FIG. 22.

Moreover, regarding an X-Y-Z coordinate system illustrated in each drawing, an X direction is an apparatus width direction, and a Y direction is an apparatus depth direction. A Z direction is a gravity direction, and indicates an apparatus height direction. In addition, a +Y direction side is set as an apparatus front surface side, and a −Y direction side is set as an apparatus rear surface side. In addition, a left side seen from the apparatus front surface side is set as a +X direction, and a right side is set as a −X direction. In addition, a +Z direction is set as an apparatus upper side (including an upper portion, an upper surface, and the like), and a −Z direction side is set as an apparatus lower side (including a lower portion, a lower surface, and the like).

In addition, hereinafter, a transporting direction where paper is transported in the printer 1 is referred to as a "downstream", and an opposite direction thereto is referred to as an "upstream".

Entire Configuration of Printer

Hereinafter, the entire configuration of the printer 1 according to the aspect of the invention will be described with mainly reference to FIGS. 1 to 4.

The printer 1 illustrated in FIG. 1 is provided with a recording head 20 (FIG. 4) as a "recording unit" which performs ink jet recording on paper, which is an example of a medium, inside the apparatus main body 2.

A power supply button or an operation button for performing various print settings and recording, a display unit which performs display contents relating to the print settings, and the like are provided on the apparatus front surface of the printer 1 of FIG. 1, and an operation panel 4 is also provided thereon.

In addition, a front surface cover 5 is provided on the apparatus front surface so as to be capable of opening and closing, and when the front surface cover 5 opens, a paper discharging tray 10 as a medium receiving portion receiving paper after being recorded, which is discharged from a paper feeding tray 7, and the apparatus main body 2 to be described later are configured to be exposed.

The paper discharging tray 10 (FIGS. 2 and 3) is provided with a plurality of trays (first tray 11 and second tray 12 to be described later) which can be displaced along the medium discharging direction (+Y axis direction), and the storage state in which at least a part of the plurality of trays is stored in the apparatus main body, and the development state in which at least one of the plurality of trays is displaced in the medium discharging direction further than that in the storage state and receives the paper are acquired.

More specifically, the paper discharging tray 10 is provided with the first tray 11 and the second tray 12 positioned on a downstream of the first tray 11 in the medium discharging direction in the development state, and the storage state (FIG. 1) in which the entire paper discharging tray 10 is stored in the apparatus main body 2, the first development state (FIG. 2) in which only the second tray 12 is displaced in the medium discharging direction (+Y axis direction) from the storage state while the first tray 11 remains at a position in the storage state, and the second development state (FIG. 3) in which the second tray 12 is displaced in the medium discharging direction from the first development state are acquired. The paper discharging tray 10 is capable of receiving paper which is discharged after being recorded when becoming the first development state (FIG. 2) or the second development state (FIG. 3).

In the storage state, the entire paper discharging tray 10 does not need to be stored in the apparatus main body 2, and if the paper discharging tray 10 is positioned nearer the apparatus main body 2 than that in the development state, a part thereof may be deviated from the apparatus main body 2.

Moreover, a configuration of the driving mechanism 30 (FIG. 11) for displacing the paper discharging tray 10 between the storage state and the development state (including the first development state and the second development state) will be described later.

A plurality of sheets of paper can be accommodated in the paper feeding tray 7 illustrated in FIG. 4, and the paper feeding tray can be attached to and detached from the apparatus main body 2.

In addition, a reference numeral 6 indicates a cover which is capable of opening and closing on a rear upper portion of the apparatus main body 2 in FIG. 1, and when the cover 6 opens, paper feeding using a rear paper feeding portion 8 (FIG. 4) is performed.

Regarding Paper Transporting Passage of Printer

Next, the paper transporting passage in the printer 1 will be described with mainly reference to FIG. 4.

First, paper feeding from the rear paper feeding portion 8 will be described, and then, paper feeding from the paper feeding tray 7 provided on an apparatus bottom portion will be described.

Moreover, in FIG. 4, a transporting passage T1 of the paper from the rear paper feeding portion 8 is illustrated by a two-dot chain line. In addition, a transporting passage T2 of the paper from the paper feeding tray 7 to an upstream side of the pair of transporting rollers 23 is illustrated by a dotted line.

The rear paper feeding portion 8 is provided with a setting portion 9 which is capable of supporting a plurality of sheets of the set paper. The uppermost paper among the paper set in the setting portion 9 is picked up by the first sending roller 13 and is sent to a downstream side. Also, the setting portion 9 is configured as a hopper which can be oscillated so that a distal end side (downstream side) of paper is advanced to and retracted from the first sending roller 13 in accordance with the number of sheets of the set paper.

The pair of transporting rollers 23 which is rotated and driven by a motor, which is not illustrated, is provided on the tip of the first sending roller 13, and the paper is sent to the bottom of the recording head 20.

Subsequently, the recording head 20 is provided on a bottom portion of a carriage 21, and the carriage 21 reciprocates in a sub scanning direction (X axis direction) by a motor which is not illustrated.

A medium supporting member 22 which supports the paper being transported is provided at a position facing the recording head 20.

The recording head 20 performs recording by discharging ink as a liquid to the paper being supported by the medium supporting member 22.

A pair of discharging rollers 24 which is rotated and driven by a motor, which is not illustrated, is provided on a downstream side of the medium supporting member 22. The paper on which recording is performed by the recording head 20 is discharged toward the paper discharging tray 10 described above by the pair of discharging rollers 24.

In addition, the printer 1 is capable of sending the paper one by one also from the paper feeding tray 7. A plurality of sheets of paper P is accommodated in the paper feeding tray 7. The paper feeding tray 7 is provided so as to be capable of sliding (displacing) between a position where the paper can be sent (FIG. 4) and a retractable position (not illustrated) at which the paper feeding tray is moved to the apparatus front surface side (the +Y axis direction in FIG. 4 is a drawing direction side of the paper feeding tray 7).

In FIG. 4, a second sending roller 14 is provided on a roller supporting member 15 which oscillates based on a rotating shaft 15*a*, and when the paper feeding tray 7 slid the most rear side of the apparatus (the −Y axis direction in FIG. 4 is an apparatus direction side of the paper feeding tray 7, or may be a paper sending-out direction side) and is present at a butting position, and the second sending roller 14 comes into contact with the uppermost sheet of the paper P accommodated in the paper feeding tray 7 and rotates, the uppermost paper is sent out from the paper feeding tray 7.

The paper P which is sent out by the second sending roller 14 is sent to the upper side along an inclined surface 84 constituting a transporting passage surface.

An intermediate roller 16 which is rotated and driven by a motor which is not illustrated is provided on the second sending roller 14 and a downstream side of the inclined surface 84, and the paper is curved and reversed by the intermediate roller 16 so as to face the apparatus front side.

The paper, which is sent along the transporting passage T2 illustrated by a dotted line, is joined up with the transporting passage T1 (two-dot chain line) in the front of the pair of transporting rollers 23, after that, on the downstream side in the same manner as the paper sent from the rear paper feeding portion 8, the paper is transported by the pair of transporting rollers 23, recording is performed thereon by the recording head 20, and then the paper is discharged toward the paper discharging tray 10 by the pair of discharging rollers 24.

In addition, in a case in which recording is performed on both sides of the paper, a front surface (outer surface) is recorded by the recording head 20 and is switched back, and the paper enters to the transporting passage T2 from the lower side of the intermediate roller 16 and is curved and reversed, so that recording can be performed on a rear (back) surface of the paper.

Regarding Configuration of Driving Mechanism of Paper Discharging Tray

Subsequently, a configuration of the driving mechanism 30 (FIG. 11) of the paper discharging tray 10 will be described.

As described above, the paper discharging tray 10 is provided with the first tray 11 and the second tray 12, and the storage state (FIG. 1) in which the entire paper discharging tray 10 is stored in the apparatus main body 2, and from the storage state, the first development state (FIG. 2) in which only the second tray 12 is displaced in the medium discharging direction (+Y axis direction) while the first tray 11 remains at a position in the storage state, and the second development state (FIG. 3) in which the first tray 11 and the second tray 12 are displaced in the medium discharging direction from the first development state are acquired.

The paper discharging tray 10 of the second development state (FIG. 3) is used when receiving the paper having a larger size (longer length) in the medium discharging direction than the paper discharging tray 10 in the first development state (FIG. 2).

The printer 1 is provided with a motor 31 which is an example of a "driving source" for driving the paper discharging tray 10, as the driving mechanism 30 (FIG. 11) for switching the storage state and the development state of the paper discharging tray 10, a first rack portion 51, a second rack portion 52, and a gear train 32 including the pinion portion 40, which are an example of a "transmission unit" for transmitting power of the motor 31 to the paper discharging tray 10. Also, the first rack portion 51 is provided on the first tray 11, and the second rack portion 52 is provided with the second tray 12.

Hereinafter, first, the gear train 32 including the pinion portion 40 will be described, and then the first rack portion 51 and the second rack portion 52 will be described.

Regarding Gear Train for Transmitting Power of Motor

The pinion portion 40 (FIGS. 11 and 14), which is a feature part of the invention, is provided with a first gear 41 as a "first rotating body" which comes into contact with the first tray 11 and transmits the power of the motor 31 to the first tray 11, and a second gear 42 as a "second rotating body" which comes into contact with the second tray 12 and transmits the power of the motor 31 to the second tray 12.

In the pinion portion 40, the first gear 41 and the second gear 42 are disposed on the same rotating shaft, and the first gear 41 and the second gear 42 are configured so as to be integrally rotated. Also, the first gear 41 and the second gear 42 have the same gear diameter and the same number of teeth as each other.

The pinion portion 40 is provided with the torsion spring 45 (FIG. 15) between the first gear 41 and the second gear 42, as an example of an "elastic member" which allows rotation of the second gear 42 with respect to the first gear 41 within a certain range. The torsion spring 45 is provided with a coil portion 46, and two arm portions 47*a* and 47*b* which are connected to the coil portion 46.

The first gear 41 and the second gear 42 are respectively provided with circular arc shaped protruding portions 41*a* and 42*a* at the center portion (FIG. 15), and the protruding portion 41*a* faces the protruding portion 42*a* as FIG. 16 in a state in which the pinion portion 40 is configured by combining the first gear 41 and the second gear 42 as FIG. 14. The coil portion 46 of the torsion spring 45 are provided around the protruding portion 41*a* and the protruding portion 42*a* which face each other (FIG. 16), and an end portion of the arm portion 47*b* is inserted into an insertion hole 42*b* of the second gear 42 (also refer to FIG. 15). An end portion of the arm portion 47*a* (FIG. 15) is inserted into the insertion hole 41*b* provided in the first gear 41. Also, the insertion hole 41*b* is provided on a surface of the first gear 41 which is not visible in FIG. 15.

Phase shifting of teeth of the first gear 41 and teeth of the second gear 42 are matched with each other, in the pinion portion 40 formed by combining the first gear 41 and the second gear 42 through the torsion spring 45 (FIG. 14). For example, in FIG. 14, in a state in which an external force is not applied to any of the first gear 41 and the second gear 42, teeth 53 of the first gear 41 and teeth 54 of the second gear 42 are overlapped with each other.

Here, as illustrated in FIG. 16, the protruding portion 41*a* and the protruding portion 42*a*, which face each other in a state in which the first gear 41 and the second gear 42 are combined, are separated from each other, and a play M1 and a play M2 which allow rotation of one of the gears (second gear 42) with respect to the other gears (for example, first gear 41) are provided. The second gear 42 can be rotated against the elastic force of the torsion spring 45 with respect to the first gear 41 by the amount of the play M1 and the play M2.

In the embodiment, the second gear 42 can be rotated in a clockwise direction or a counterclockwise direction with respect to the first gear 41 by one tooth. For example, when the protruding portion 42*a* is close to the protruding portion 41*a* so as to remove the play M1 in FIG. 16, the second gear 42 is relatively rotated in a counterclockwise direction with respect to the first gear 41 in FIG. 14, and the teeth 53 of the first gear 41 and teeth 55 of the second gear 42 are overlapped with each other. When the protruding portion 42*a* is close to the protruding portion 41*a* so as to remove the play M2 in FIG. 16, the second gear 42 is relatively rotated in a clockwise direction with respect to the first gear 41 in FIG. 14, and the teeth 53 of the first gear 41 and teeth 56 of the second gear 42 are overlapped with each other.

As a result, phase deviation between the first gear 41 and the second gear 42 can be suppressed or avoided.

Also, the "elastic member" provided between the first gear 41 and the second gear 42 is not limited to the torsion spring 45, and for example, other types of spring members such as a plate spring or a tension spring can be used.

The gear train 32 (FIGS. 11 and 12) is provided with a third gear 34 which is engaged with the first gear 41 in the pinion portion 40, and is connected to a worm gear 33 through a fourth gear 35, a fifth gear 36 (FIG. 12), a sixth gear 37 (FIG. 12), a seventh gear 38, an eighth gear 39, a ninth gear 43, and a tenth gear 44 from the third gear 34. The worm gear 33 is provided in a rotating shaft 31*a* of the motor 31.

When the rotating shaft 31*a* of the motor 31 is rotated in a +A direction in FIG. 11, the first gear 41 is rotated in a +B direction, and then the entire pinion portion 40 is rotated in the +B direction. When the motor 31 is reversely driven (the rotating shaft 31*a* is rotated in a −A direction), the first gear 41 is rotated in a −B direction, and the entire pinion portion 40 is rotated in the −B direction.

Regarding First Rack Portion and Second Rack Portion

As illustrated in FIGS. 5 and 6, the first rack portion 51 which is provided with a plurality of teeth is provided on a side surface of the first tray 11. In addition, the second rack portion 52 which is provided with a plurality of teeth is provided on a side surface of the second tray 12.

The teeth of the first gear 41 can be engaged between the teeth of the first rack portion 51 in the pinion portion 40, and the teeth of the second gear 42 can be engaged between the teeth of the second rack portion 52 in the pinion portion 40.

Also, the first rack portion 51 and the second rack portion 52 respectively have the same intervals between the teeth.

Regarding Operation of Paper Discharging Tray

Subsequently, a specific operation of the paper discharging tray 10 by the driving mechanism 30 will be described. First, a development operation of developing the paper discharging tray 10 from the storage state (FIGS. 1 and 7) to the second development state (FIGS. 3 and 10).

FIG. 5 illustrates the paper discharging tray 10 in the storage state. In the paper discharging tray 10 (FIG. 5) in the storage state, end portions of the first rack portion 51 of the first tray 11 and the second rack portion 52 of the second tray 12 in the −Y axis direction are aligned, phases of teeth of up and down rack portions (first rack portion 51 and second rack portion 52) are aligned. The second rack portion 52 of the second tray 12 is longer than the first rack portion 51 of the first tray 11 in the Y axis direction, and a region S (FIG. 5) where the first rack portion 51 does not overlap is provided in an end portion of the second rack portion 52 in the +Y axis direction at the time of the storage state.

As illustrated in FIG. 7, when the paper discharging tray 10 becomes the storage state, the driving mechanism 30 in the apparatus main body 2 (FIG. 1) is disposed so as to be engaged with the region S (FIG. 5) where the second gear 42 of the pinion portion 40 is provided on the end portion of the second rack portion 52 in the +Y axis direction. Also, in FIG. 7, the first gear 41 is not engaged with the first rack portion 51.

When the paper discharging tray 10 becomes the first development state (FIG. 2) in which only the second tray 12 is displaced in the +Y axis direction which is the medium discharging direction from the storage state (also refer to FIG. 1) illustrated in FIG. 7, the motor 31 moves so that the rotating shaft 31*a* is rotated in the +A direction (FIG. 11). At this time, the pinion portion 40 is rotated in the +B direction (FIG. 11).

As described above, since the first gear 41 in the storage state (FIG. 7) is not engaged with the first rack portion 51, only the second tray 12 is displaced in the +Y axis direction while the first tray 11 remains at the same position as that in the storage state.

Here, the first tray 11 is provided with a first portion to be contacted 57 and a second portion to be contacted 58 on a surface facing the second tray 12 (FIGS. 6 and 13). The first portion to be contacted 57 and the second portion to be contacted 58 are provided at an interval in the medium discharging direction (+Y axis direction).

In addition, the second tray 12 is provided with the regulating unit 59 on an upper surface thereof. Also, the first portion to be contacted 57, the second portion to be contacted 58, and the regulating unit 59 are provided in an apparatus width direction in pairs.

The regulating unit 59 regulates predetermined movement or more of the second tray 12 with respect to the first tray 11 in a development direction (+Y axis direction) by coming into contact with the first portion to be contacted 57, and regulates predetermined movement or more of the second tray 12 with respect to the first tray 11 in a storage direction (−Y axis direction) by coming into contact with the second portion to be contacted 58. That is, the second tray 12 is advanced to and retracted from the first tray 11 within a predetermined range.

Specifically, in the storage state of the paper discharging tray 10, the regulating unit 59 on the second tray 12 side is in contact with the second portion to be contacted 58 on the first tray 11 side as illustrated in an upper drawing of FIG. 13, a position of the second tray 12 with respect to the first tray 11 is determined, and the second tray 12 is no longer inserted in the −Y axis direction.

Also, the pinion portion 40 is rotated in the +B direction by driving of the motor 31, and when only the second tray 12 is displaced in the +Y axis direction, the regulating unit 59 also moves in the +Y axis direction. When the regulating unit 59 of the second tray 12 moves to the first portion to be contacted 57 of the first tray 11 as illustrated in a lower drawing of FIG. 13, the movement of the second tray 12 with respect to the first tray 11 in the +Y axis direction is regulated. A state illustrated in the lower drawing of FIG. 13 is the first development state the paper discharging tray 10 illustrated in FIG. 8, which is a state in which the second tray 12 is the most displaced with respect to the first tray 11 in the +Y axis direction.

Also, the paper discharging tray 10 becomes the first development state (FIG. 8) from the storage state (FIG. 7), only the second gear 42 of the pinion portion 40 is engaged with the second rack portion 52 of the second tray 12.

Subsequently, the paper discharging tray 10 transits to the second development state (FIGS. 3 and 10) from the first development state (FIGS. 2 and 8). At this time, the first gear 41 comes into contact with the first tray 11.

After the paper discharging tray 10 becomes the first development state (FIG. 8), the regulating unit 59 comes into contact with the first portion to be contacted 57, and thus a relative position relationship of the second tray 12 with respect to the first tray 11 does not vary. In addition, when the paper discharging tray 10 becomes the first development state, the end portion of the first rack portion 51 of the first tray 11 in the +Y axis direction side and the end portion of the second rack portion 52 of the second tray 12 in the −Y axis direction side are overlapped with each other. In a region D where the first rack portion 51 and the second rack portion 52 are overlapped with each other, both the first gear 41 and the second gear 42 of the pinion portion 40 are respectively engaged with the corresponding rack portions (FIG. 9).

When the pinion portion 40 (first gear 41 and second gear 42) is engaged with the first rack portion 51 and the second rack portion 52 in the region D, and the motor 31 is driven, the first tray 11 is displaced in the +Y axis direction while maintaining the relative position relationship of the second tray 12 and the first tray 11 in the first development state.

Further, when the first tray 11 is displaced in the +Y axis direction, and the pinion portion 40 comes out from the region D, only the first gear 41 in the pinion portion 40 is engaged with the first rack portion 51 of the first tray 11, but the first tray is displaced to a predetermined position in the Y axis direction where the paper discharging tray 10 becomes the second development state (FIGS. 3 and 10) while maintaining the relative position relationship of the first tray 11 and the second tray 12 in the first development state.

A lever type detecting sensor 60 as a position determining sensor which determines a stop position of the first tray 11 is provided on the apparatus main body 2 side of the printer 1. A slit 61 is provided on the end portion side of the first tray 11 in the −Y axis direction. The lever type detecting sensor 60 and the slit 61 are present at the same position as in the X axis direction.

When the paper discharging tray 10 is in the storage state (FIG. 7), or when the first tray 11 is in the first development state (FIG. 8) at the same position as in the storage state, the lever type detecting sensor 60 becomes a state of being pushed up by the first tray 11 and in contact with a medium mounting surface of the first tray 11. For example, this state is set as an ON state.

During transition of the paper discharging tray 10 from the first development state (FIG. 8) to the second development state (FIG. 10), when the slit 61 of the first tray 11 passes through a position facing the lever type detecting sensor 60 (FIG. 9), the lever type detecting sensor 60, which is pushed up by the first tray 11, drops off to the slit 61 so as to become an OFF state.

Based on the position (FIG. 9) where the lever type detecting sensor 60 becomes the OFF state, a remaining driving amount of the motor 31 in order for the paper discharging tray 10 to become the second development state (FIG. 10) is determined.

The position where the lever type detecting sensor 60 becomes the OFF state may be set to, for example, a position where a length of the paper discharging tray becomes a size corresponding the size of paper that the paper discharging tray 10 frequently uses. Accordingly, it is possible to set the length of the paper discharging tray 10 to a length corresponding to that of paper which is frequently used with high accuracy.

A position determining sensor is not limited to the lever type sensor, and an optical sensor or the like can be used.

Also, the first portion to be contacted 57 and the regulating unit 59, and the second portion to be contacted 58 and the regulating unit 59 are disposed to come into contact with each other at a position where the phases of the teeth of the first rack portion 51 and the second rack portion 52 are matched with each other. Accordingly, in a state in which the movement of the second tray 12 with respect to the first tray 11 is regulated, the phases of the teeth of the first rack portion 51 and the second rack portion 52 can be matched with each other.

Therefore, the pinion portion 40 smoothly transits between a state in which only the second gear 42 is engaged with the second rack portion 52 (FIG. 8) and a state in which the first gear 41 and the second gear 42 are engaged with the first rack portion 51 and the second rack portion 52, which are vertically overlapped with each other, at the same time (FIG. 9). Here, matching of the phases of the rack portions and the teeth means that the rack portions and the teeth are engaged with each other without affecting the rotation of the gears due to hitting the teeth to each other, when the teeth and the rack portions of the gears are engaged with each other by rotating of the gears.

Also, storage of the paper discharging tray 10, that is, when the paper discharging tray 10 transits from the second development state (FIG. 10) to the storage state (FIG. 7), the storage can be performed by a reverse-rotating operation of the development operation described above. When the motor 31 is reversely rotated (the rotating shaft 31*a* is rotated in the −A direction in FIG. 11), the pinion portion 40 is rotated in the −B direction.

Accordingly, when the paper discharging tray 10 transits from the second development state (FIG. 10) to the first development state (FIG. 8), the first gear 41 comes into contact with the first tray 11, and when the paper discharging tray transits from the first development state (FIG. 8) to the storage state (FIG. 7), the second gear 42 comes into contact with the second tray 12. Therefore, it is possible to transit the paper discharging tray 10 from the second development state to the storage state.

As seen described above, since the driving mechanism 30 of the paper discharging tray 10 is provided with the first gear 41, which comes into contact with the first tray 11 and transmits the power of the motor 31 to the first tray 11, and the second gear 42, which comes into contact with the second tray 12 and transmits the power of the motor 31 to the second tray 12, displacement operation of each tray can be smoothly performed by directly transmitting rotation power of the motor 31 to each tray, and more particularly, the displacement operation of the tray (second tray 12) positioned at a downstream side in the development state can be also smoothly performed.

In the embodiment, the paper discharging tray 10 constituted by two trays (first tray 11 and second tray 12) is described, but the paper discharging tray can be constituted of three or more trays. For example, a third tray, which is positioned on a downstream side of the second tray 12, can be provided on a lower side of the second tray 12 in the development state. In this case, a third rack portion is provided on a side surface of the third tray, the third gear which is engaged with the third rack portion can be provided on a lower side of the second gear 42 of the pinion portion 40 and can be provided coaxially with the first gear 41 and the second gear 42.

In addition, in the embodiment, the first gear 41 and the second gear 42 constituting the pinion portion 40 are configured to respectively come into contact with the side surface of the first tray 11 and the second tray 12.

In each tray configured in a flat plate shape, the side surface is a part having relatively high stiffness. When the first gear 41 and the second gear 42 are configured to come into contact with the side surfaces of the trays that the gears respectively correspond to, deformation of the first tray 11 when the first gear 41 comes into contact with the first tray 11, and deformation of the second tray 12 when the second gear 42 comes into contact with the second tray 12 can be suppressed.

Also, the rack portion can also be provided on a part other than the side surface of each tray constituting the paper discharging tray 10, for example, an upper surface or a lower surface of the tray.

In addition, in the driving mechanism 30 of the embodiment, a friction clutch 48 is provided between the motor 31 and the first gear 41, and between the motor 31 and the second gear 42, that is, between the motor 31 and the pinion portion 40. In the embodiment, the friction clutch 48 is provided in the seventh gear 38.

A torque of the friction clutch 48 is greater than a sliding load of the tray at the time of being driven by the motor 31, and the tray which is manually moved is set to be smaller than a force for rotating the motor 31. Accordingly, a driving force thereof is transmitted to each tray at the time of being driven by the motor 31, and when the tray is manually driven, it is possible to move the tray to be moved with a light force without transmitting the force for rotating the motor 31 of the tray, to the motor 31.

Therefore, a user can switch the storage state to the development state of the paper discharging tray 10 by manual.

Regarding Modification Example of First Rack Portion and Second Rack Portion

The second rack portion 52 is displaced with respect to the first rack portion 51 in the +Y axis direction, and at least any one of a distal end side (+Y axis direction side) of the first rack portion 51 and a rear end side (−Y axis direction side) of the second rack portion 52 constituting the region D (FIG. 11), where the first rack portion 51 and the second rack portion 52 are overlapped with each other in a state in which the regulating unit 59 is in contact with the first portion to be contacted 57 (not illustrated in FIG. 13), can be formed so that the teeth are gradually lower toward the end portion side. FIGS. 17 and 18 illustrate the rear end side of the second rack portion 52. In FIGS. 17 and 18, a part illustrated by a reference numeral d corresponds to the region D.

As illustrated in FIGS. 17 and 18, in the second rack portion 52, teeth 52*a* in the part d are formed lower as it goes to the end portion side (−Y axis direction side). It is not illustrated in the drawings, but the teeth are formed lower as it goes to the +Y axis direction side in the same manner as the distal end side (+Y axis direction side) of the first rack portion 51.

With this configuration, the phases of the teeth of the first rack portion 51 and the second rack portion 52 in the region D (FIG. 11) can be easily matched with each other.

In addition, instead of a so called rack and pinion mechanism in which the first rack portion 51, the second rack portion 52, and the pinion portion 40 are used as in this embodiment, it is also possible to use, for example, a configuration in which the side surfaces (the side surface where the teeth of the rack portion are provided) of the first tray 11 and the second tray 12 are formed on a friction surface, and a fraction roller is used as the "first rotating body" and the "second rotating body" that come into contact with the friction surface.

Regarding Modification Example of Driving Mechanism of Paper Discharging Tray

In the driving mechanism 30 (FIG. 11) according to the embodiment, when the third gear 34 is engaged with the first gear 41 of two gears constituting the pinion portion 40, power is transmitted to the pinion portion 40. That is, even when the paper discharging tray 10 becomes the development state from the storage state (hereinafter, called as "at the time of opening"), or on the contrary, when the paper discharging tray becomes the storage state from the development state (hereinafter, called as "at the time of closing"), the power is transmitted to the first gear 41.

Here, at the time of opening the paper discharging tray 10, only the second gear 42 of the pinion portion 40 is engaged with the second rack portion 52 immediately after start of driving so that the second tray 12 is displaced. Meanwhile, at the time of closing the paper discharging tray 10, only the first gear 41 of the pinion portion 40 is engaged with the first rack portion 51 immediately after the start of driving so that the first tray 11 is displaced. That is, at the time of opening and closing the paper discharging tray 10, a gear of the pinion portion 40, which serves to drive trays immediately after the start of driving, is switched to the second gear 42 and the first gear 41.

Under the consideration of the above description, at the time of opening and closing the paper discharging tray 10, it is possible to change a driving gear in the pinion portion 40 which is a final transmission gear.

Specifically, the gear is switched to the third gear 34 which is a front gear of the pinion portion 40 in the gear train 32 (FIG. 11), and a planetary gear mechanism 70 illustrated in FIG. 19 is used. The planetary gear mechanism 70 is provided with a planetary gear 71*a* and a planetary gear 71*b*. The planetary gear 71*a* and the planetary gear 71*b* are respectively engaged with the fourth gear 35 with which the third gear 34 in FIG. 11 is engaged, the planetary gear 71*a* is present at the same position as the second gear 42 in a height direction (Z axis direction), and the planetary gear 71*b* is present at the same position as the first gear 41 in the height direction (Z axis direction).

Also, at the time of opening and closing the paper discharging tray 10, the gear that engages the pinion portion 40 is switched to a planetary gear 71*a* and a planetary gear 71*b*.

At the time of the opening of the paper discharging tray 10, the planetary gear mechanism 70 is in a state of the upper drawing of FIG. 19, the planetary gear 71*a* is engaged with the second gear 42 of the pinion portion 40, and power is transmitted to the second gear 42, whereby the pinion portion 40 is driven.

At the time of the closing of the paper discharging tray 10, the planetary gear mechanism 70 is in a state of the lower drawing of FIG. 19, the planetary gear 71*b* is engaged with the first gear 41 of the pinion portion 40, and the power is transmitted to the first gear 41, whereby the pinion portion 40 is driven.

Accordingly, at the time of both the opening and closing, the pinion portion 40 can be driven by setting the gear as the driving gear (the second gear 42 at the time of opening, and the first gear 41 at the time of closing) which serves to drive the trays immediately after the start of driving, and thus development and storage of the paper discharging tray 10 can be smoothly initiated.

Another Configuration of Paper Discharging Tray

Another configuration of the paper discharging tray 10 will be described with reference to FIGS. 20 and 21.

Inside the apparatus main body 2, as illustrated in FIG. 20, a pair of guide rails (a left side guide rail 80*a* and a right side guide rail 80*b*) that guides the right and left end portions of the paper discharging tray 10 are provided. The left side guide rail 80*a* is provided in a left side guide frame 81*a*, and the right side guide rail 80*b* is provided in a right side guide frame 81*b*. Also, FIG. 20 illustrates a state in which an exterior of the apparatus main body 2 is removed.

The left side guide rail 80*a* and the right side guide rail 80*b* support, in the paper discharging tray 10, an end portion in a width direction (X axis direction) of the second tray 12 positioned on the lower side, and guide the movement of the second tray 12 in the Y axis direction.

The paper discharging tray 10 is configured so that, in the second development state, the rear end of the second tray 12 overlaps at least a part of the left side guide rail 80*a* and the right side guide rail 80*b* in the Y axis direction (the lower drawing in FIG. 21). Also, in the lower drawing of FIG. 21, the reference numeral 82 indicates the rear end position of the second tray 12, and the reference numeral 83 indicates the distal end position of the guide rail (right side guide rail 80*b*).

That is, at the time of a state in which the second tray 12 is most drawn out (in the second development state), the rear end of the second tray 12 is supported by the distal ends of the left side guide rail 80*a* and the right side guide rail 80*b*. Therefore, the posture of the paper discharging tray 10 in the second development state is stabilized.

Meanwhile, in the second development state, almost the second tray 12 in the longitudinal direction (Y axis direction) protrudes toward the apparatus front surface side (+Y axis direction side), and a load is applied to the distal ends of the left side guide rail 80*a* and the right side guide rail 80*b* which support the rear end of the second tray 12.

Therefore, a certain amount of the length of the rear end side (−Y axis direction side) of the first tray 11 remains on the apparatus main body 2 side, and the load being applied to the distal ends of the left side guide rail 80*a* and the right side guide rail 80*b* is reduced.

Here, in the paper discharging tray 10 in the embodiment, in the storage state illustrated in the upper drawing of FIG. 21, the rear end of the first tray 11 and the rear end of the second tray 12 hang toward the apparatus rear surface side up to a position near the inclined surface 84 constituting a passage surface of the transporting passage T2 (FIG. 2) from the paper feeding tray 7. In the paper discharging tray 10 in the storage state, at least the rear end of the second tray 12 is separated from the inclined surface 84 (a portion illustrated by an arrow H in the upper drawing of FIG. 21), and, in the first development state in which the second tray 12 is present at the same position as in the storage state, the second tray 12 does not hinder the transportation of the paper being fed through the transporting passage T2 (FIG. 2).

In the storage state of the paper discharging tray 10, when the second tray 12 is stored in a state of being hung up to a position very close to the rear surface side of the apparatus, it is possible to elongate the length (Y axis direction) of the second tray 12 as much as possible with respect to the depth size of the apparatus.

Therefore, it is possible to satisfy both the reduction of the load being applied to the distal ends of the left side guide rail 80*a* and the right side guide rail 80*b* while elongating the length of the first tray 11 on the rear end side which remains in the apparatus main body 2 when the paper discharging tray 10 is transited to the second development state, and secureness of the length of the paper discharging tray 10 in the second development state.

Another Configuration of Printer

Next, another configuration of the printer 1 will be described with reference to FIGS. 22 and 23.

The motor 31 of the driving mechanism 30 of the paper discharging tray 10 is constituted so as to be capable of being removed and exchanged. As illustrated in FIGS. 7 and 21, the driving mechanism 30 is disposed on the left side of the paper discharging tray 10, that is, the left side of the apparatus main body 2 when seen from the apparatus front surface side.

Here, the motor 31 is positioned on the inside of the left side base frame 85 (refer to FIG. 22 and also FIG. 20) which is present on the inside of the exterior of the apparatus main body 2 and is fixed to the left side guide frame 81*a* illustrated in FIG. 23 (also refer to FIG. 20) using fixation screws 86 and 86. Therefore, in order to exchange the motor 31 from the left side of the apparatus main body 2, it is necessary to remove the exterior (not illustrated in FIG. 22) of the apparatus main body 2 and the left side base frame 85, and the operation becomes troublesome.

Therefore, in the printer 1, the motor 31 is configured so as to be capable of being removed from the bottom surface side of the apparatus main body 2 without removing the left side base frame 85.

Specifically, as illustrated in FIG. 22, the left side base frame 85 is provided with through holes 87 and 87 at positions corresponding to the fixation screws 86 and 86, and is configured so as to be capable of being accessed to the fixation screws 86 and 86 without removing the left side base frame 85.

When the fixation screws 86 and 86 are removed, a frame for a motor 88 (FIG. 23) that supports the motor 31 is removed from the left side guide frame 81*a*, and a state in which the motor 31 can be detached from each frame for the motor 88 is formed.

The bottom portion (not illustrated) of the left side guide frame 81*a* is open at a position corresponding to the motor 31, and is configured to allow the motor 31 (including the frame for the motor 88) removed from the left side guide frame 81*a* to be extracted downwards. The above-described configuration enables the motor 31 to be removed from the apparatus main body 2 and be exchanged without removing the left side base frame 85.

Another Configuration of First Tray

Figure 24:
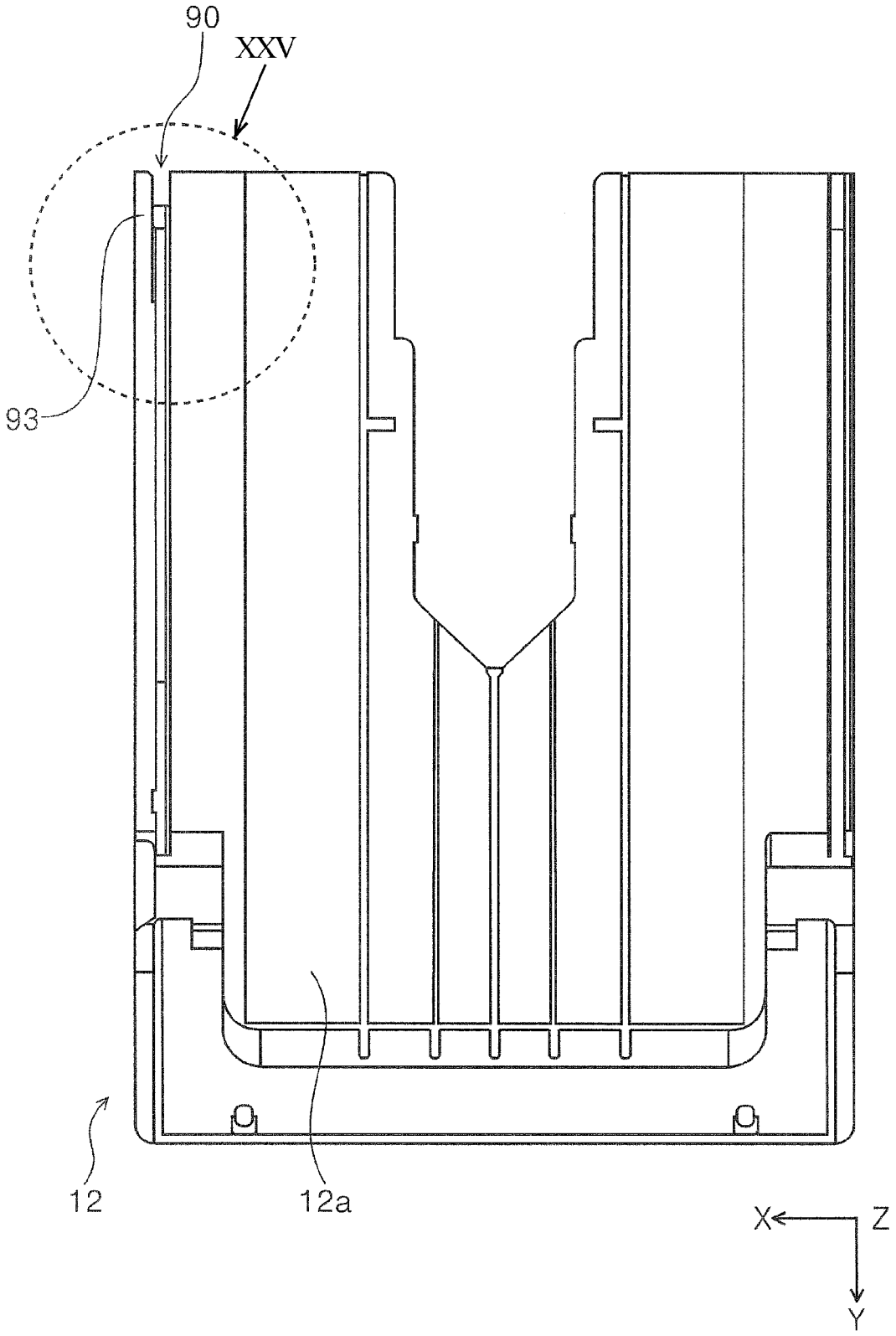
FIG. 24 is a plan view illustrating a modification example of the paper discharging tray.
Figure 25:
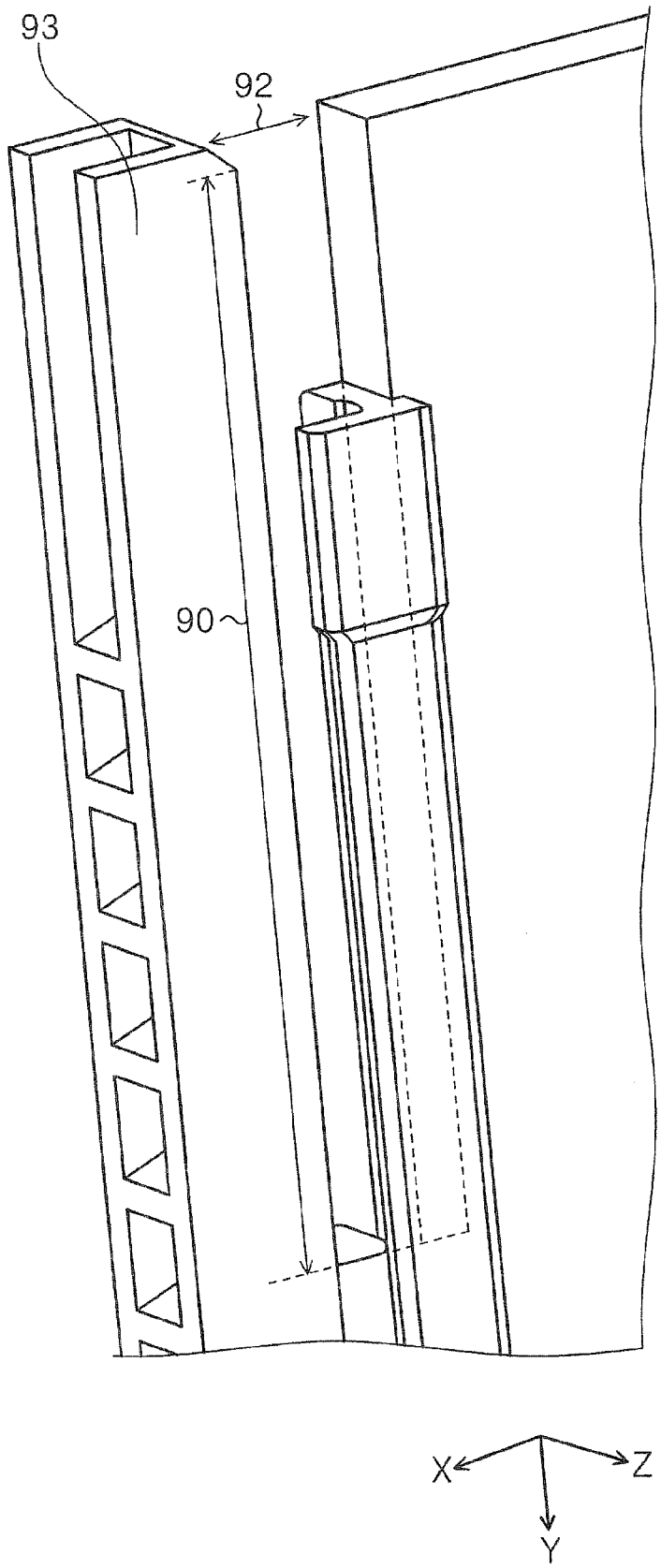
FIG. 25 is an enlarged perspective view of a XXV part of FIG. 24.
Figure 26:
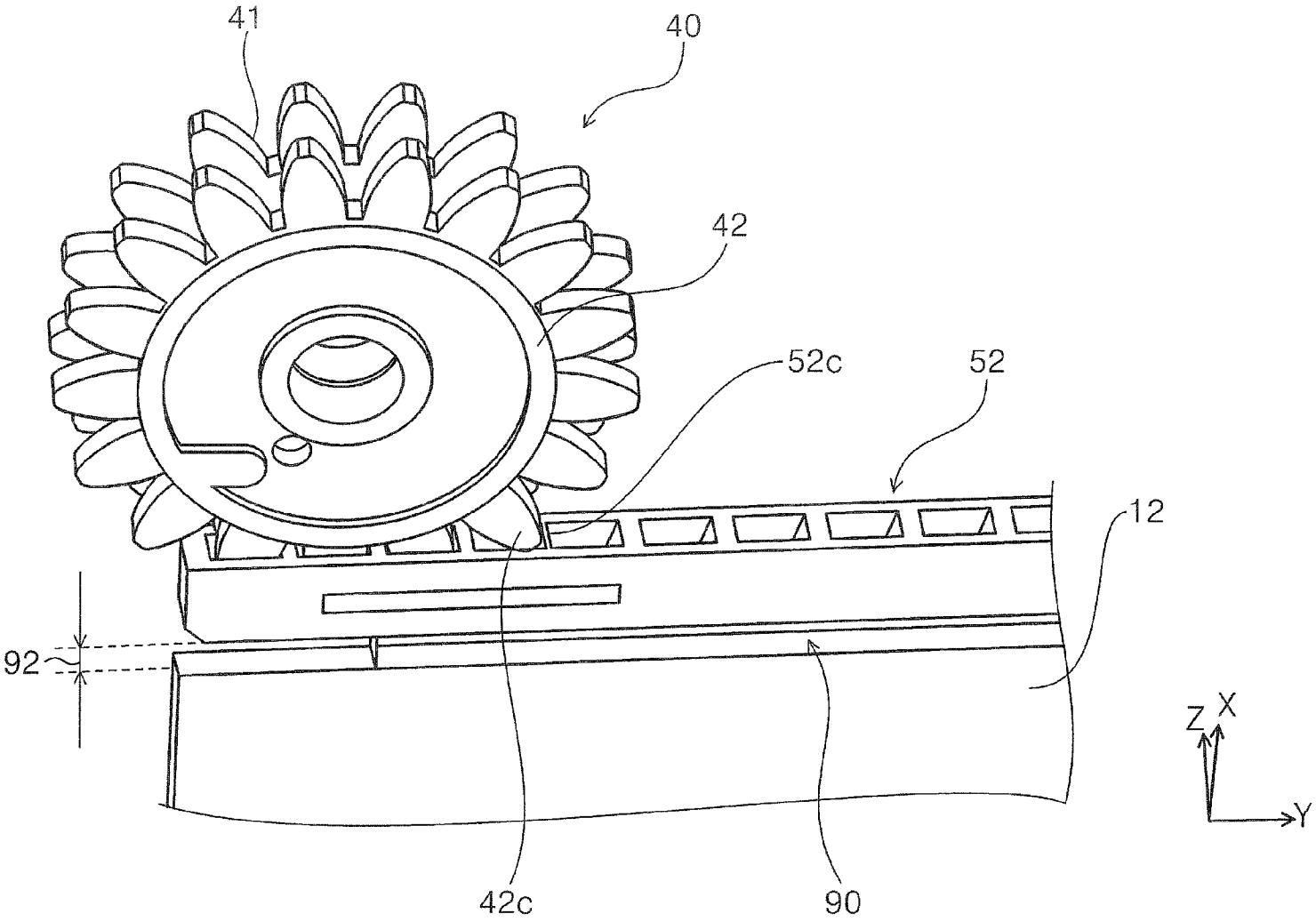
FIG. 26 is a perspective view illustrating a state in which the pinion portion is engaged with a second rack portion of a second tray in FIG. 24.

Another configuration of the first tray 11 will be described with reference to FIGS. 24 to 26. FIG. 24 is a plan view illustrating a modification example of the paper discharging tray. FIG. 25 is an enlarged perspective view of a XXV portion in FIG. 24. FIG. 26 is a perspective view illustrating a state in which the pinion portion engages the second rack portion of the second tray illustrated in FIG. 24.

The first tray 11 (FIGS. 24 and 25) includes a first slit 90 which is opened on the upstream side in the medium discharging direction, that is, on an end portion side on the −Y axis direction side and extends along the second rack portion 52.

In addition, the first tray 11 is configured so that a side surface side provided with the second rack portion 52 can be elastically deformed in a direction where an opening width 92 (FIG. 25) of the first slit 90 narrows (−X axis direction).

More specifically, the first slit 90 is provided in the vicinity of the second rack portion 52, and a portion 93 (FIG. 25) on the +X axis direction side with respect to the first slit 90 can be elastically deformed in the −X axis direction.

Originally, the teeth of the second gear 42 mesh with portions between the teeth of the second rack portion 52; however, for example, when the phases of the second rack portion 52 and the second gear 42 slightly deviate from each other, there are cases in which the teeth (teeth 42*c* in FIG. 26) of the second gear 42 come into contact with the teeth (teeth 52*c* in FIG. 26) of the second rack portion 52 and are locked (becomes immobile) as illustrated in FIG. 26.

When the first slit 90 is provided in the embodiment, it is possible to form a constitution in which the portion 93 on the side surface side elastically deforms in the −X axis direction where the opening width 92 of the first slit 90 narrows and is escaped, in a case in which the teeth of the second gear 42 come into contact with the teeth of the second rack portion 52, and in a case in which a force is applied to the side surface provided with the second rack portion 52 due to the second gear 42 (pinion portion 40) that is continuously driven. When the portion 93 on the side surface side elastically deforms toward the inside of the first slit 90, it becomes easy for the second rack portion 52 and the teeth of the second gear 42 to mesh each other, and it is possible to suppress a disadvantage of the second gear 42 being locked.

Also, the length (the length in the Y axis direction) of the first slit 90 is set depending on the stiffness of a material (for example, a resin material such as plastic) constituting the first tray 11 or the length of the width of the portion 93 on the side surface side.

Regarding Another Example of Pinion Portion

Figure 27:
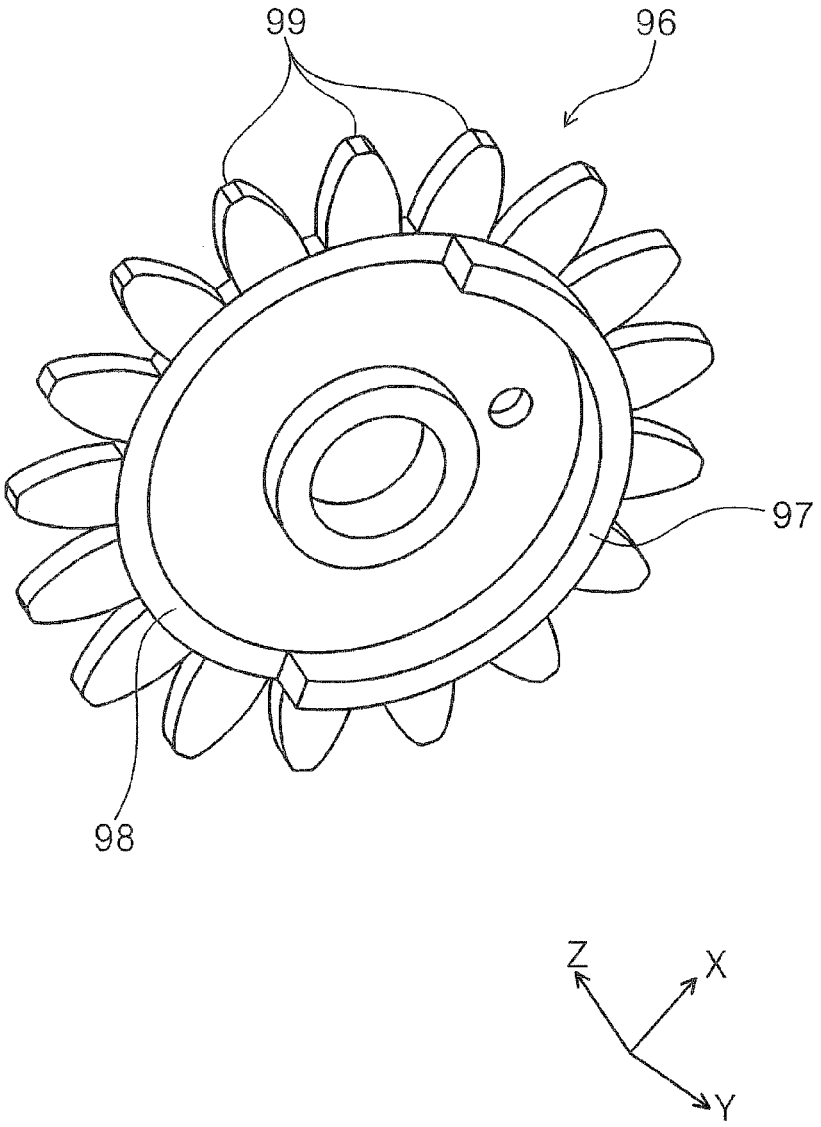
FIG. 27 is a perspective view of a gear configuration member.

In the embodiment, it is possible to use a pinion portion 100 (FIG. 28) formed by combining two gear configuration members 96 as illustrated in FIG. 27 instead of the pinion portion 40 described with reference to FIGS. 14 to 16.

Figure 28:
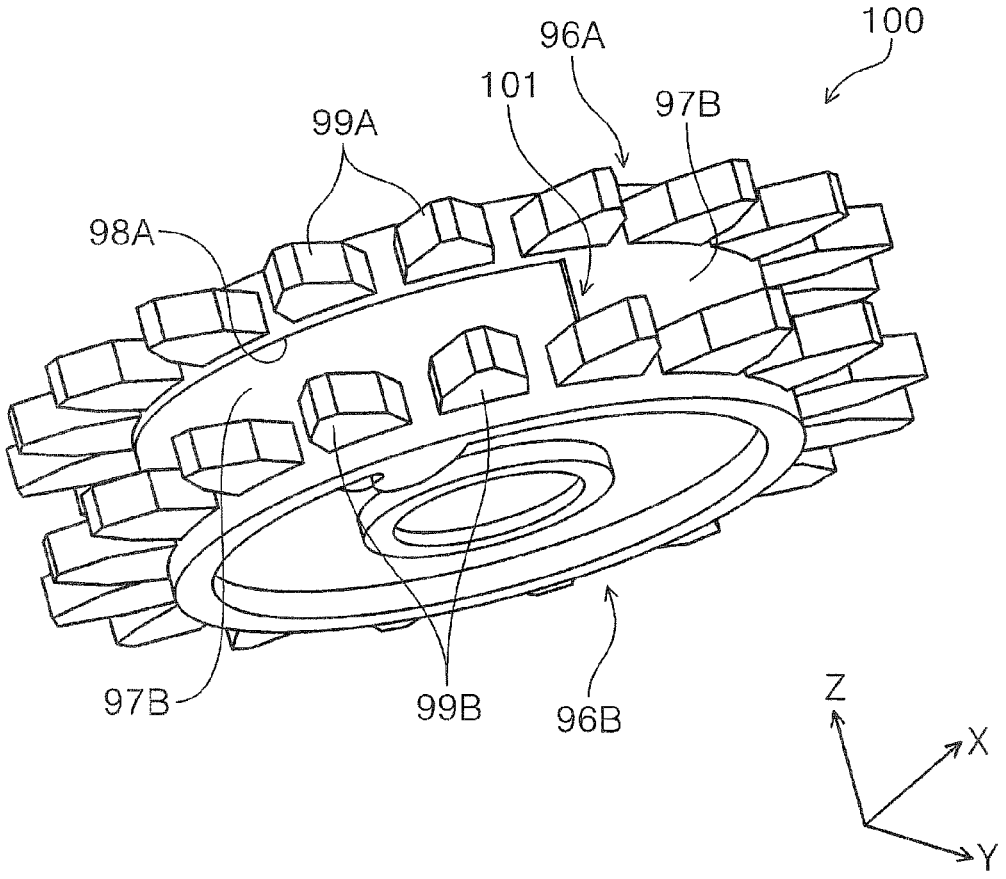
FIG. 28 is a perspective view of the pinion portion formed by combining the gear configuration members illustrated in FIG. 27.

FIG. 27 is a perspective view of the gear configuration member. FIG. 28 is a perspective view of a pinion portion formed by combining the gear configuration members illustrated in FIG. 27.

The gear configuration member 96 (FIG. 27) includes a plurality of teeth 99 at the outer circumference and includes semicircular protruding portions 97 inside the teeth 99. In addition, the remaining semicircular portions not provided with the protruding portion 97 inside the teeth 99 at the outer circumference will be referred to as recess portions 98. It is possible to form the pinion portion 100 by combining and integrating two gear configuration members 96 as described above (a gear configuration member 96A and a gear configuration member 96B in FIG. 28).

In FIG. 28, the protruding portion 97 and the teeth 99 in the gear configuration member 96B on the one side are indicated by the reference numeral 97B and the reference numeral 97B, and the protruding portion 97, the recess portions 98, and the teeth 99 in the gear configuration member 96A on the other side are indicated by the reference numeral 97A, the reference numeral 98A, and the reference numeral 99A.

The pinion portion 100 is integrally formed by making the gear configuration member 96A and the gear configuration member 96B face each other with the protruding portions 97A and 97B thereof being placed inside and combining the protruding portions 97B of the gear configuration member 96B on one side and the recess portions 98A of the gear configuration member 96A on the other side. In the pinion portion 100, in a state in which the two gear configuration members 96A and 96B are combined, phase shift of the teeth 99A and 99B of both the two gear configuration members 96A and 96B are matched with each other.

The semicircular protruding portion 97 provided in the gear configuration member 96 (FIG. 27) is an arc that is almost a semicircle. More specifically, the semicircular protruding portion 97 is formed to an arc that is smaller than a semicircle by a manufacturing tolerance of the gear configuration member 96 which is formed of a resin material such as plastic.

When the protruding portion 97 is designed to a perfect semicircle, in a case in which the protruding portion 97 is formed with a positive tolerance, there are cases in which it becomes impossible to combine the two gear configuration members 96. When the protruding portion 97 is formed to an arc that is smaller than a semicircle by a manufacturing tolerance, it is possible to suppress or avoid a concern that it may become impossible to combine the two gear configuration members 96.

Also, between the protruding portions 97 of the two combined gear configuration members 96 (a portion indicated by the reference numeral 101 in FIG. 28), a tolerance-size gap may be provided.

Regarding Phase Matching Operation in Paper Discharging Tray

In the embodiment, the first portion to be contacted 57 and the regulating unit 59 are disposed so as to come into contact with each other at a position at which the phases of the teeth of the first rack portion 51 and the second rack portion 52 match; however, there are cases in which the phases of the teeth of the first rack portion 51 and the second rack portion 52 deviate from each other after the regulating unit 59 comes into contact with the first portion to be contacted 57 due to inertia or vibration during the movement of the paper discharging tray 10.

For example, in a case in which the paper discharging tray 10 (FIG. 7) in the storage state is developed to the first development state (FIG. 8), when the phases of the teeth of the first rack portion 51 and the second rack portion 52 deviate from each other, it is not possible to smoothly transit to a state in which the first gear 41 and the second gear 42 of the pinion portion 40 mesh with both the first rack portion 51 and the second rack portion 52 (FIG. 9).

In order to avoid this problem, the printer 1 is configured so as to be capable of performing a phase matching operation described below using a control unit which is not illustrated.

Figure 29:
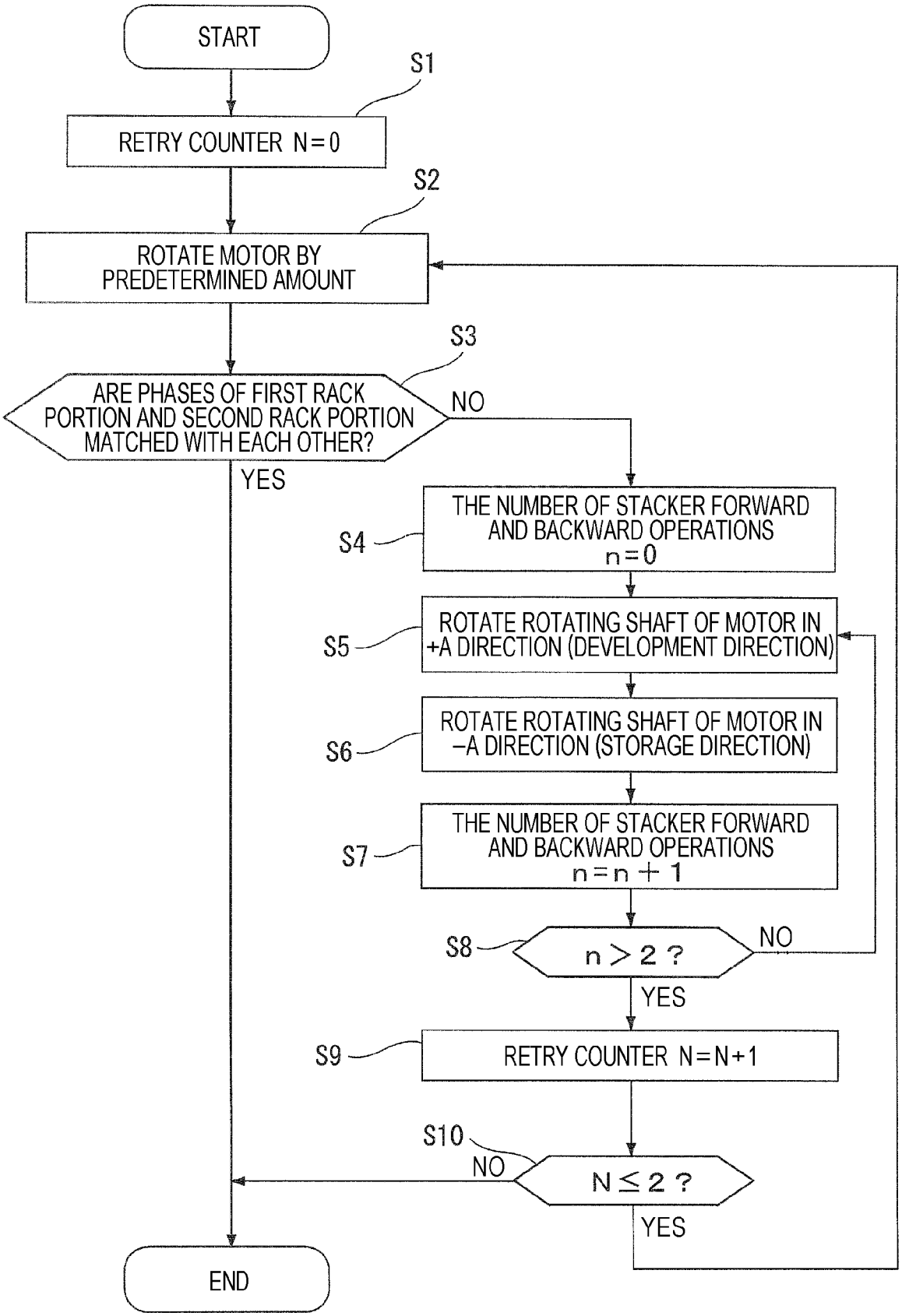
FIG. 29 is a flow chart for describing a phase matching operation.

FIG. 29 is a flowchart describing the phase matching operation.

Hereinafter, the phase matching operation in a case in which the paper discharging tray 10 is developed from the storage state (FIG. 7) will be described with mainly reference to FIG. 29.

In a case in which the paper discharging tray 10 is developed from the storage state illustrated in FIG. 7, the motor 31 is driven so that the rotating shaft 31*a* (FIG. 11) rotates in the +A direction. Due to the driving of the motor 31, the pinion portion 40 rotates in the +B direction, the second tray 12 is displaced in the +Y axis direction, and the paper discharging tray 10 is into the first development state (FIG. 8).

At this time, the pinion portion 40 is positioned in front of (on the +Y axis direction side) of the region D in which the first rack portion 51 and the second rack portion 52 overlap each other.

From this state, the "phase matching operation" that matches the phases of the first rack portion 51 and the second rack portion 52 is initiated.

In Step S1, the number of times of the phase matching operation performed is confirmed. In Step S1, the phase matching operation is not yet performed, and thus a retry counter N is zero (0). Subsequently, the rotating shaft 31*a* of the motor 31 is rotated a predetermined rotation amount in a direction in which the regulating unit 59 comes into contact with the first portion to be contacted 57, that is, the +A direction (Step S2).

Subsequent to Step S2, whether or not the phases of the first rack portion 51 and the second rack portion 52 match is determined (Step S3). When the motor 31 is rotated in Step S2, in a case in which a load on the motor 31 is equal to or less than a predetermined value, the phases of the first rack portion 51 and the second rack portion 52 are determined to match (YES in Step S3), and the phase matching operation ends without performing a stacker forward and backward operation described below.

When the motor 31 is rotated in Step S2, in a case in which a predetermined load or more is applied to the motor 31, it is determined that the phases of the first rack portion 51 and the second rack portion 52 deviate from each other and the pinion portion 40 is locked (NO in Step S3).

In a case in which determination is NO in Step S3, the stacker forward and backward operation, which will continue in Step S4 and later, is performed.

In Step S4, the number of times of the stacker forward and backward operation performed is confirmed. In Step S4, the number n of times of the stacker forward and backward operation is set to zero (0).

In Step S5, the rotating shaft 31*a* of the motor 31 is rotated in the +A direction, that is, the direction in which the paper discharging tray 10 is developed. Subsequently, in Step S6, the rotating shaft 31*a* of the motor 31 is rotated in the −A direction, that is, the direction in which the paper discharging tray 10 is stored.

Step S4 and Step S5 are considered as one set, and Step S4 and Step S5 are repeated until determination is YES in Step S8 in which the number n of times of the stacker forward and backward operation in Step S7 is accumulated and whether or not the number n of times of the stacker forward and backward operation is more than two is determined, that is, until the number n of times of the stacker forward and backward operation reaches three.

The paper discharging tray 10 (first tray 11 and second tray 12) is moved forward and backward by repeating Step S4 and Step S5, whereby the phases of the first rack portion 51 and the second rack portion 52 which have deviated are aligned.

In a case in which determination is YES in Step S8, the retry counter N which is the number of times of the phase matching operation performed becomes +1 (Step S9). That is, an operation of repeating the stacker forward and backward operation three times is one cycle of the phase matching operation.

In Step S10, whether or not the retry counter N is two or less is determined, and, in a case in which determination is YES in Step S10, that is, the number of times of the phase matching operation performed is two or less, the process returns to Step S2.

In a case in which determination is NO in Step S10, that is, the phase matching operation has been performed three times, the control of performing the phase matching operation ends.

Also, in the printer 1 of the embodiment, when the phase matching operation in which three times of the stacker forward and backward operation is considered as one set is performed three times, the phases of the first rack portion 51 and the second rack portion 52 are determined to be aligned, and the boundary value of the retry counter N which is determined in Step S10 is set to two, but the boundary value of the number n of times of the stacker forward and backward operation or the retry counter N which is determined to be large or small in Step S8 or Step S10 can be changed.

Figure 30:
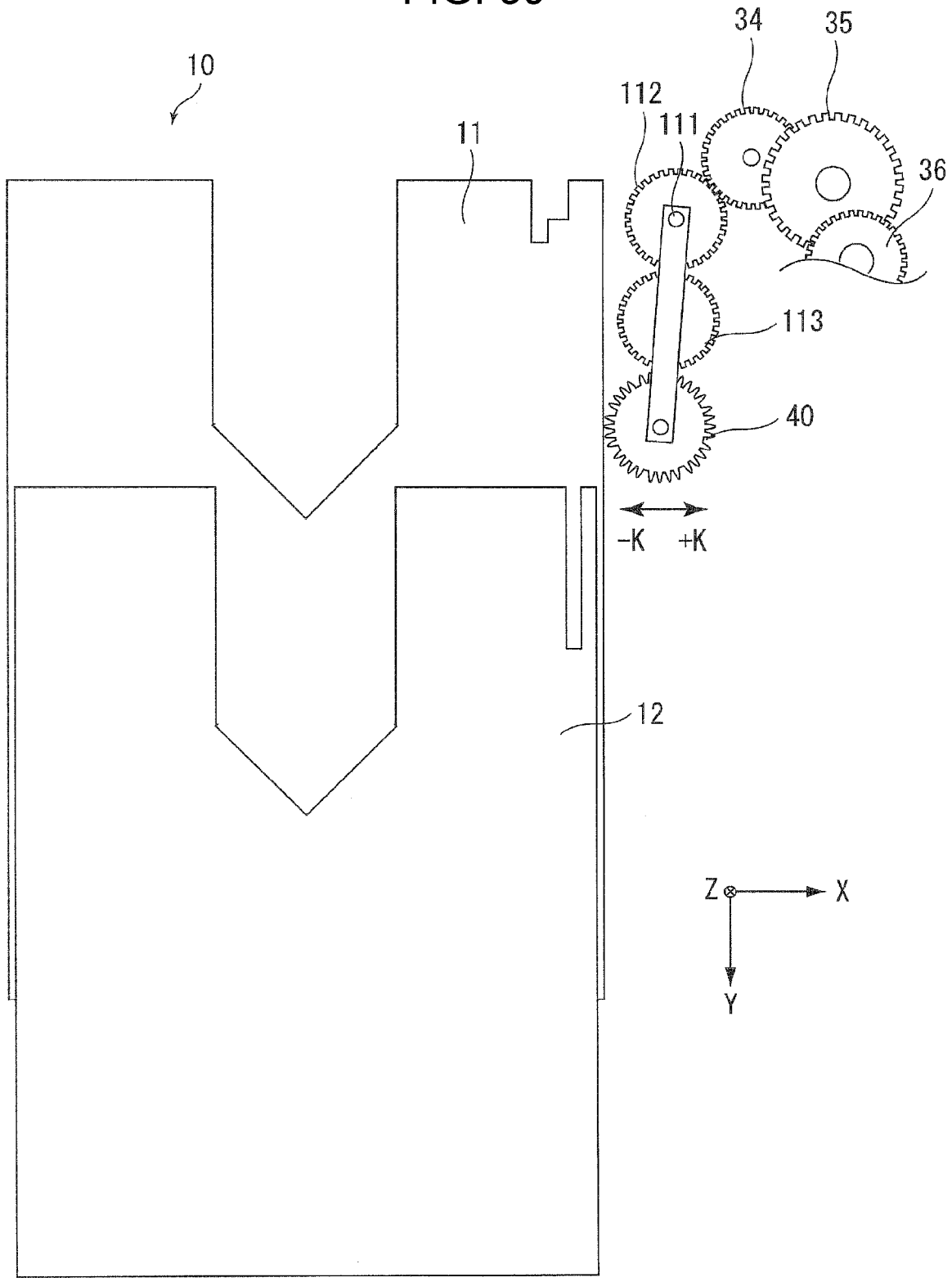
FIG. 30 is a view for describing another modification example of the driving mechanism of the paper discharging tray.

Regarding Another Modification Example of Driving Mechanism of Paper Discharging Tray In the embodiment, it is possible to use a driving mechanism 110 as illustrated in FIG. 30 instead of the driving mechanism 30 of the paper discharging tray 10 described with reference to FIG. 11 and FIG. 12. FIG. 30 is a view for describing another modification example of the driving mechanism of the paper discharging tray.

The driving mechanism 110 illustrated in FIG. 30 is configured so that the pinion portion 40 can be displaced in a +K direction indicated by an arrow in FIG. 30. More specifically, the pinion portion 40 is configured so as to be capable of being vibrated in a direction of advancing to and retracting from the side surface of the second tray 12 provided with the second rack portion 52 using a vibration shaft 111 as a shaft, and is pressed in a direction (−K direction) of approximating the side surface of the second tray 12 provided with the second rack portion 52.

The driving mechanism 110 has the same configuration as a gear train 32 illustrated in FIG. 12 from a worm gear 33 (not illustrated in FIG. 30) provided in the rotating shaft 31*a* of the motor 31 (not illustrated in FIG. 30) to a third gear 34. Gears indicated by the reference numeral 112 and the reference numeral 113 are gears that transmit power from the third gear 34 to the pinion portion 40.

As previously described using FIG. 26, for example, there are cases in which the teeth (teeth 42*c* in FIG. 26) of the second gear 42 come into contact with the teeth (teeth 52*c* in FIG. 26) of the second rack portion 52. When the teeth 42*c* of the second gear 42 come into contact with the teeth 52*c* of the second rack portion 52, the second gear 42 (pinion portion 40) becomes immobile; however, when the second gear 42 (pinion portion 40) is continuously driven, a load is applied to the side surface of the second tray 12 provided with the second rack portion 52.

As illustrated in FIG. 30, the pinion portion 40 is configured so as to be capable of being vibrated in the direction of advancing to and retracting from the side surface of the second tray 12 provided with the second rack portion 52, and it is also possible to provide a configuration in which, in a case in which the teeth of the second gear 42 come into contact with the teeth of the second rack portion 52 as illustrated in FIG. 26 by pressing the pinion portion in the −K direction, the pinion portion 40 escapes in the +K direction. Therefore, it is possible to suppress the application of a load to the side surface of the second tray 12 caused by the second gear 42 being continuous driven after coming into contact with the teeth of the second rack portion 52.

Regarding Display in Operation Panel

As described above, in the embodiment, the seventh gear 38 constituting the driving mechanism 30 is provided with a friction clutch 48 and is configured so that the storage state and the development state of the paper discharging tray 10 can be manually switched.

Here, for example, in a case in which the second tray 12 is pushed by a hand and stored from the second development state (FIG. 10) of the paper discharging tray 10, in the beginning, only the second gear 42 of the pinion portion 40 engages the second rack portion 52 of the second tray 12, and, when the state of FIG. 9 which is in the middle of transition from the second development state (FIG. 10) to the first development state is formed, the first gear 41 and the second gear 42 of the pinion portion 40 are respectively engaged with the first rack portion 51 of the first tray 11 and the second rack portion 52 of the second tray 12.

When the state in which only one gear (second gear 42) is engaged with the rack portion (second rack portion 52) (FIG. 10) transits to the state in which two gears (first gear 41 and second gear 42) are respectively engaged with the rack portions (the first rack portion 51 and the second rack portion 52) (FIG. 9), resistance generated when the second tray 12 is pushed by a hand increases, and thus there are cases in which users feel a difficulty in operation.

Therefore, in order to facilitate the switching operation between the storage state and the development state of the paper discharging tray 10, it is desirable to display buttons for performing the state switching of the paper discharging tray 10 on the home screen of the operation panel 4.

When the state switching buttons of the paper discharging tray 10 are provided on the home screen of the operation panel 4, it becomes easy for users to perform the development or storage of the paper discharging tray 10. Therefore, it is possible to reduce cases in which users manually operate the paper discharging tray 10.

Also, the state switching buttons displayed on the operation panel 4 may be buttons for performing any one of a storage operation or a development operation (for example, a storage button).

Regarding Another Configuration of Paper Discharging Tray

Figure 31:
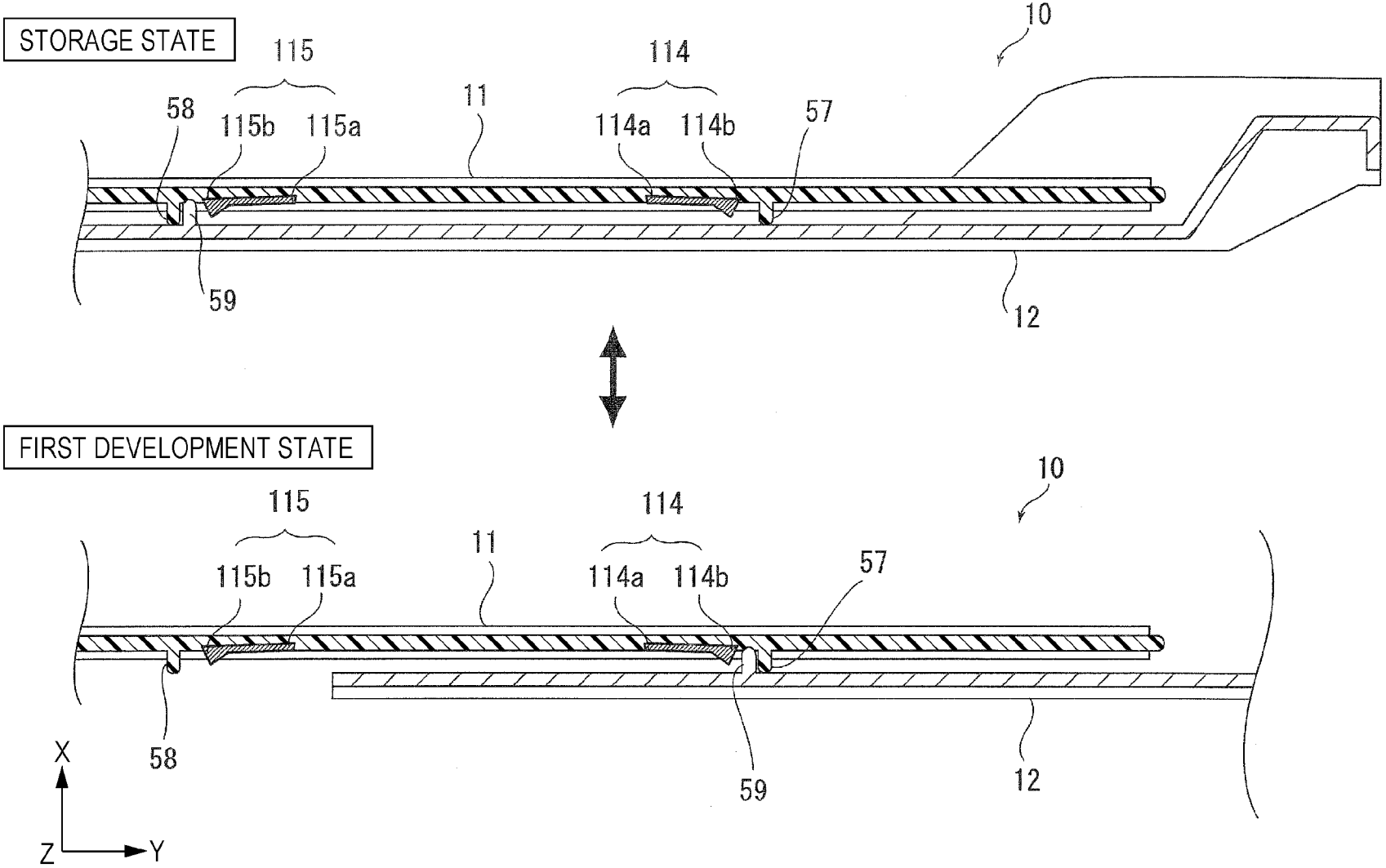
FIG. 31 is a view for describing another configuration of the paper discharging tray.

Another configuration of the paper discharging tray 10 will be described with reference to FIG. 31. FIG. 31 is a view for describing another configuration of the paper discharging tray 10.

As described with reference to FIG. 13, the regulating unit 59 provided in the second tray 12 regulates the movement of the second tray 12 to the first tray 11 in the development direction (+Y axis direction), which is caused by the contact with the first portion to be contacted 57 provided in the first tray 11, to a predetermined extent and regulates the movement of the second tray 12 to the first tray 11 in the storage direction (−Y axis direction), which is caused by the contact with the second portion to be contacted 58 provided in the first tray 11, to a predetermined extent.

Here, as illustrated in FIG. 31, it is possible to provide a first lock portion 114 for maintaining the state in which the regulating unit 59 is in contact with the first portion to be contacted 57 and a second lock portion 115 for maintaining the state in which the regulating unit 59 is in contact with the second portion to be contacted 58 in the first tray 11.

Each of the first lock portion 114 and the second lock portion 115 is configured of, for example, a plate spring that vibrates from a pivot point 114*a* or 115*a* as a pivot point and is pressed so that a mountain portion 114*b* or 115*b* provided in an end portion on a side opposite to the pivot point 114*a* or 115*a* protrudes from the lower surface of the first tray 11.

In the storage state (the upper drawing of FIG. 31) of the paper discharging tray 10, the regulating unit 59 is positioned between the second portion to be contacted 58 and the mountain portion 115*b* of the second lock portion 115, and the movement of the second tray 12 to the first tray 11 in the +Y direction is regulated using the mountain portion 115*b*.

In the first development state (the lower drawing of FIG. 31) of the paper discharging tray 10, the regulating unit 59 is positioned between the first portion to be contacted 57 and the mountain portion 114*b* of the first lock portion 114, and the movement of the second tray 12 to the first tray 11 in the −Y direction is regulated using the mountain portion 114*b*.

In a case in which the locked state of the second tray 12 using the first lock portion 114 or the second lock portion 115 is released, for example, in a case in which the second tray 12 is moved in the +Y axis direction from the state of the upper drawing of FIG. 31, a predetermined force is applied to the second tray 12 in the +Y axis direction, and thus the regulating unit 59 presses the mountain portion 115*b* against the elastic force of the plating spring, and the mountain portion 115*b* is overcome. Therefore, it is possible to release the locked state and move the second tray 12 in the +Y axis direction.

Regarding Guide Rail of Paper Discharging Tray

Figure 32:
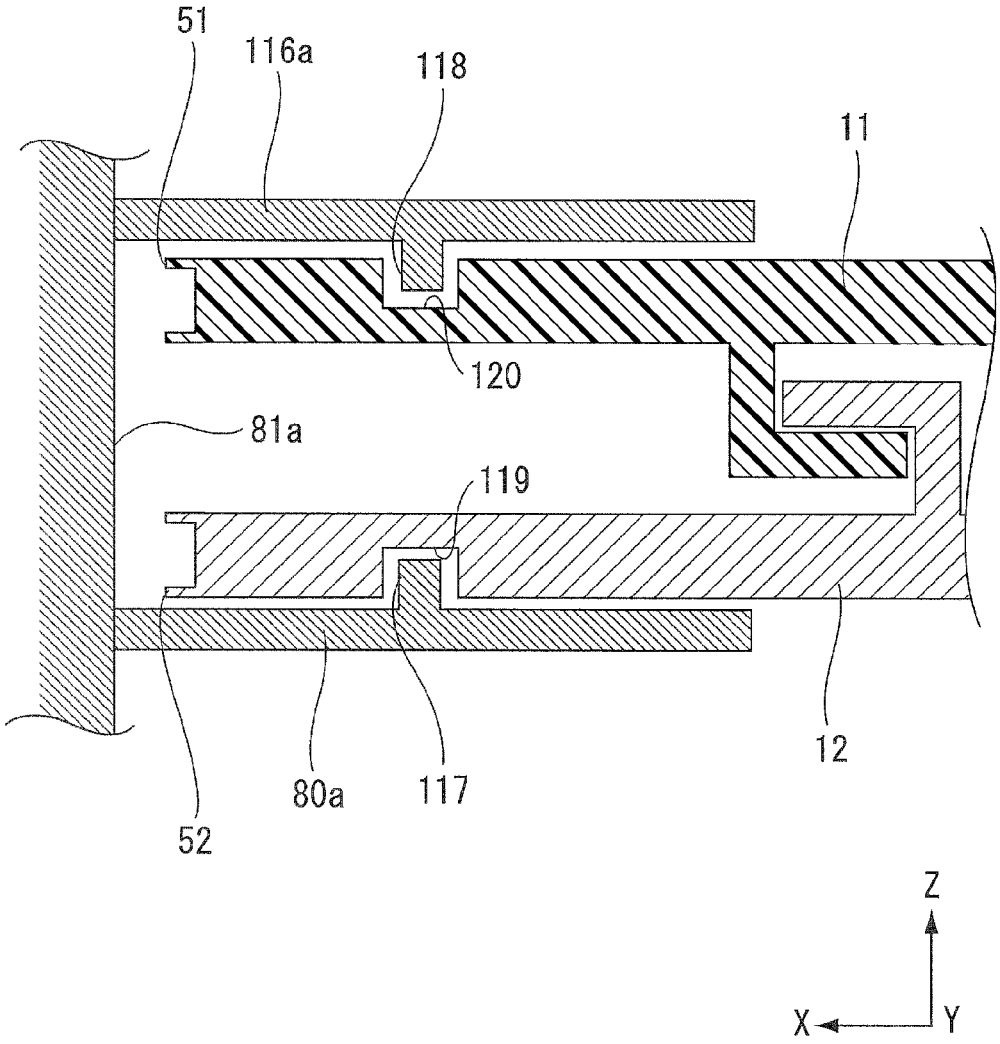
FIG. 32 is a sectional view of an X-Y plane of the paper discharging tray which is supported by a left side guide rail.

A guide rail of the paper discharging tray will be described with reference to FIG. 32. FIG. 32 is a plan view of an X-Y plane of the paper discharging tray supported by the left side guide rail.

First, the pair of guide rails (left side guide rail 80*a* and right guide rail 80*b*) that guide the right and left end portions of the paper discharging tray 10 will be described with reference to FIGS. 20 and 21.

The left side guide rail 80*a* and the right guide rail 80*b* are guide rails that support the second tray 12 from the below in the paper discharging tray 10. Above the left side guide rail 80*a* and the right side guide rail 80*b*, the left side guide rail 116*a* and the right side guide rail 116*b* (refer to FIG. 20 respectively) which guide the first tray 11 in the paper discharging tray 10 are respectively provided.

Furthermore, in the left side guide rail 80*a*, a rib 117 (FIGS. 20 and 32) is provided along an extension direction (Y axis direction) of the left side guide rail 80*a*. The rib 117 is fitted into a recess portion 119 provided in the second tray 12 as illustrated in FIG. 32, and the position of the second tray 12 in the width direction (X axis direction) is determined.

In addition, similar to the left side guide rail 80*a*, in the left side guide rail 116*a* as well which is positioned on the upper side, a rib 118 (FIG. 32) is provided along an extension direction (Y axis direction) of the left side guide rail 116*a*. Also, the rib 118 is not visible in FIG. 20. The rib 118 is fitted into a recess portion 120 provided in the first tray 11 as illustrated in FIG. 32, and the position of the first tray 11 in the width direction is determined. Therefore, the position of the paper discharging tray 10 in the width direction is determined.

In the first tray 11 and the second tray 12, the positions of the first tray 11 and the second tray 12 are determined by the rib 118 and the rib 117 provided in the left side guide rail 116*a* and the left side guide rail 80*a* which guide the +X axis direction side (the left side when seen from the apparatus front surface side) in which the first rack portion 51 and the second rack portion 52 are provided, and thus it is possible to facilitate the matching of the phases of the first rack portion 51 and the second rack portion 52.

The invention is not limited to the above-described embodiment and can be modified in various manners within the scope of the invention described in the claims, and it is needless to say that the above-described modifications are also in the scope of the present invention.

The entire disclosure of Japanese Patent Application No. 2017-057906, filed Mar. 23, 2017 and No. 2017-155731, filed Aug. 10, 2017 are expressly incorporated by reference herein.

What is claimed is:

1. A recording apparatus comprising:

an apparatus main body that includes a recording unit which performs recording on a medium;

a medium receiving portion that includes a plurality of trays capable of being displaced in a medium discharging direction and becomes a storage state in which at least some of the plurality of trays are stored in the apparatus main body or a development state in which at least one of the plurality of trays is displaced in the medium discharging direction more than in the storage state and receives the medium;

a driving source that drives the medium receiving portion; and a transmission unit that transmits power of the driving source to the medium receiving portion, wherein the plurality of trays includes at least a first tray and a second tray which is positioned on a downstream side of the first tray in the medium discharging direction in the development state, wherein the transmission unit includes a first rotating body which comes into contact with the first tray and transmits the power of the driving source to the first tray and a second rotating body which comes into contact with the second tray and transmits the power of the driving source to the second tray, wherein the development state includes a first development state in which only the second tray is displaced in the medium discharging direction from the storage state while the first tray remains at a position at the storage state and a second development state in which the second tray is displaced in the medium discharging direction from the first development state, and wherein, in the transmission unit, the second rotating body comes into contact with the second tray when the medium receiving portion transits from the storage state to the first development state, and the first rotating body comes into contact with the first tray when the medium receiving portion transits from the first development state to the second development state.

2. The recording apparatus according to claim 1, wherein the first rotating body comes into contact with a side surface of the first tray, and the second rotating body comes into contact with a side surface of the second tray.

3. The recording apparatus according to claim 1, wherein, in the transmission unit, the first rotating body comes into contact with the first tray when the medium receiving portion transits from the second development state to the first development state, and the second rotating body comes into contact with the second tray when the medium receiving portion transits from the first development state to the storage state.

4. The recording apparatus according to claim 1, wherein the transmission unit includes a first rack portion including a plurality of teeth on a side surface of the first tray, a second rack portion including a plurality of teeth on a side surface of the second tray, and a pinion portion in which a first gear, as the first rotating body, which engages the teeth of the first rack portion, and a second gear, as the second rotating body, which engages the teeth of the second rack portion are disposed on the same rotating shaft.

5. The recording apparatus according to claim 4, wherein the pinion portion includes an elastic member that allows rotation of the second gear with respect to the first gear in a certain range, between the first gear and the second gear.

6. The recording apparatus according to claim 4, wherein the first tray includes a first portion to be contacted and a second portion to be contacted which are provided in the medium discharging direction at an interval, wherein the second tray includes a regulating unit which comes into contact with the first portion to be contacted so as to regulate movement of the second tray with respect to the first tray in a development direction to a predetermined extent and comes into contact with the second portion to be contacted so as to regulate movement of the second tray with respect to the first tray in a storage direction to a predetermined extent, and wherein the first portion to be contacted and the regulating unit, and the second portion to be contacted and the regulating unit come into contact with each other respectively at a position at which phases match of the first rack portion are matched and the teeth of the first gear and phases match of the second rack portion and the teeth of the second gear are matched.

7. The recording apparatus according to claim 6, wherein a distal end side of the first rack portion in the medium discharging direction and a rear end side of the second rack portion in the medium discharging direction overlap each other when the regulating unit comes into contact with the first portion to be contacted, and wherein at least one of the distal end side of the first rack portion and the rear end side of the second rack portion is formed so that the teeth become lower stepwise toward an end portion side.

8. The recording apparatus according to claim 4, wherein the second tray includes a first slit which is open on an end portion side on an upstream side in the medium discharging direction and is extended along the second rack portion, and the side surface side provided with the second rack portion is configured to be elastically deformable in a direction in which an opening width of the first slit narrows.

9. The recording apparatus according to claim 1, wherein the first tray includes a first portion to be contacted and a second portion to be contacted which are provided in the medium discharging direction at an interval, and wherein the second tray includes a regulating unit which comes into contact with the first portion to be contacted so as to regulate movement of the second tray with respect to the first tray in a development direction to a predetermined extent and comes into contact with the second portion to be contacted so as to regulate movement of the second tray with respect to the first tray in a storage direction to a predetermined extent.

10. The recording apparatus according to claim 1, wherein the transmission unit includes a friction clutch between the driving source and the first rotating body and between the driving source and the second rotating body, respectively.

* * * * *